US007173233B1

(12) United States Patent
Livingston et al.

(10) Patent No.: US 7,173,233 B1
(45) Date of Patent: Feb. 6, 2007

(54) COUNTER

(75) Inventors: Rod Livingston, Richmond, IN (US); Robert Roczynski, Cheshire, CT (US)

(73) Assignee: Record Products of America, Inc., Hamden, CT (US)

( * ) Notice: Subject to any disclaimer, the term of this patent is extended or adjusted under 35 U.S.C. 154(b) by 81 days.

(21) Appl. No.: 10/872,320

(22) Filed: Jun. 18, 2004

Related U.S. Application Data

(60) Provisional application No. 60/480,160, filed on Jun. 20, 2003.

(51) Int. Cl.
*G06M 7/00* (2006.01)
*G06M 9/00* (2006.01)

(52) U.S. Cl. ..... 250/221; 250/224; 250/559.27; 377/8; 377/53

(58) Field of Classification Search ..... 250/221, 250/222.1, 224, 559.27; 377/8, 53
See application file for complete search history.

(56) References Cited

U.S. PATENT DOCUMENTS

| | | | | |
|---|---|---|---|---|
| 3,835,306 | A * | 9/1974 | Bills et al. | 377/8 |
| 4,298,790 | A | 11/1981 | Decker et al. | |
| 4,771,443 | A | 9/1988 | Mohan et al. | |
| 5,457,312 | A | 10/1995 | Mansour | |
| 6,683,321 | B2 | 1/2004 | Livingston et al. | |

* cited by examiner

*Primary Examiner*—Kevin Pyo
(74) *Attorney, Agent, or Firm*—Bachman & LaPointe, P.C.

(57) ABSTRACT

A lite-counting apparatus counts lites in a longitudinal array. During a traversal by the apparatus of a peripheral portion of the array, a beam of radiation is passed from at least one source to at least one detector. Based upon changes in the relative path taken by the beam, the articles may be counted.

16 Claims, 25 Drawing Sheets

230
232
242
240
260
250
254
252
206
262

COUNTER

CROSS-REFERENCE TO RELATED APPLICATION

Benefit is claimed of U.S. patent application 60/480,160, filed Jun. 20, 2003 and entitled "Counter", the disclosure of which is incorporated by reference in its entirety herein as if set forth at length.

BACKGROUND OF THE INVENTION

The invention relates to the glass industry. More particularly, the invention relates to the counting of arrays of glass sheets or "lites".

In the glass industry, there is a need to count the number of lites in various arrays of lites. The arrays may be vertical stacks or horizontal arrays of lites (e.g., with portions exposed through the top of a carton, crate, or other storage container). Various lite-counting apparatus have been suggested in U.S. Pat. Nos. 4,298,790, 4,771,443, and 5,457,312.

It has been proposed to import technology used to count optical disks. Exemplary optical disk counter technology is found in U.S. Pat. No. 6,683,321. It has been proposed to use the technology of the '321 patent count lites. Specifically, it has been proposed to configure such a counter to accommodate corners of the lites along an edge of the array and drive the laser and detector from such a unit along the edge to count the lites. Nevertheless, there remains room for improvement in the counting of lites.

SUMMARY OF THE INVENTION

Accordingly, one aspect of the invention involves an apparatus for counting articles in a longitudinal array. The apparatus has a wheel positioned to rotate during a traversal by the apparatus of a peripheral portion of the array. An encoder is coupled to the wheel to provide an output indicative of a length of the traversal. A radiant energy source is positioned to direct radiant energy toward the array during the traversal. Detection means to detect a return of the radiant energy from the array during the traversal along a number of different paths. A logic circuit is coupled to the encoder and the detector for counting the articles.

In various implementations, the apparatus may have a second wheel and an endless loop tread may be engaged to the first and second wheels and positioned so as to contact the array during the traversal so as to rotate the first and second wheels during the traversal. The apparatus may have a handle having a grip and a shaft extending from the grip and having a length effective to space the wheel from the grip by a distance of at least 0.2 m. An input device may be electrically or electronically coupled to the logic circuit and positioned to receive input from a hand of the user while that hand is on the grip. The apparatus may include third and fourth wheels and a second endless loop tread engaged to the third and fourth wheels and positioned so as to contact the array during the traversal so as to rotate the third and fourth wheels during the traversal. The source may include a laser diode. There may be a number of the detectors positioned to preferentially detect the return along a number of different paths. The logic circuit may be configured to calculate a characteristic article thickness. The logic circuit may be configured to update the calculated characteristic article thickness during the traversal.

Another aspect of the invention involves an apparatus for counting articles in a longitudinal array. The apparatus includes a radiant energy source positioned to direct radiant energy toward the array during a traversal of the array. A number of detectors are positioned to detect a return of the radiant energy from the array during the traversal. A logic circuit is coupled to the detectors for counting the articles in the array.

In various implementations, the logic circuit may be configured to count the articles based upon changes in the relative return detected among the detectors. The detectors may be positioned at a number of different locations along a direction of the traversal. The source may include only a single laser diode. The apparatus may further include means for tracking a distance of the traversal.

Another aspect of the invention involves a method for counting articles in a group of articles. A counting apparatus is traversed along a periphery of the group. During the traversal, at least one incident beam of radiation is caused to traverse the group. A radiation return is detected resulting from the incident beam. Based upon different paths of the radiation return relative to the apparatus, a count of the articles is determined. In various implementations, the incident beam may be emitted by a single source and the return may be detected by a number of detectors. The detectors may respectively be associated with respective paths of the different paths. The articles may be glass lites and the traversal may comprise rolling the apparatus over edges of the lites.

Another aspect of the invention involves a method for counting articles in a group of articles. A counting apparatus is traversed along a periphery of the group. The traversal causes rotation of a rotary member and causes at least one incident beam of radiation to traverse the group. An amount of the rotation is detected. A radiation return resulting from the at least one incident beam is detected. The return includes a first return from sides of one or more of the articles and a second return from edges of one or more of the articles and having a greater and more rapid fluctuation in path than the first return. A count of the articles is determined responsive to a combination of the amount of the rotation and the radiation return.

In various implementations, the articles may be glass lites and the traversal may comprise rolling the apparatus over edges of the lites. The lites may be partially within a carton. The lites may be in a horizontal array. The detecting may involve detecting relative degrees of fluctuation of the first and second returns.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
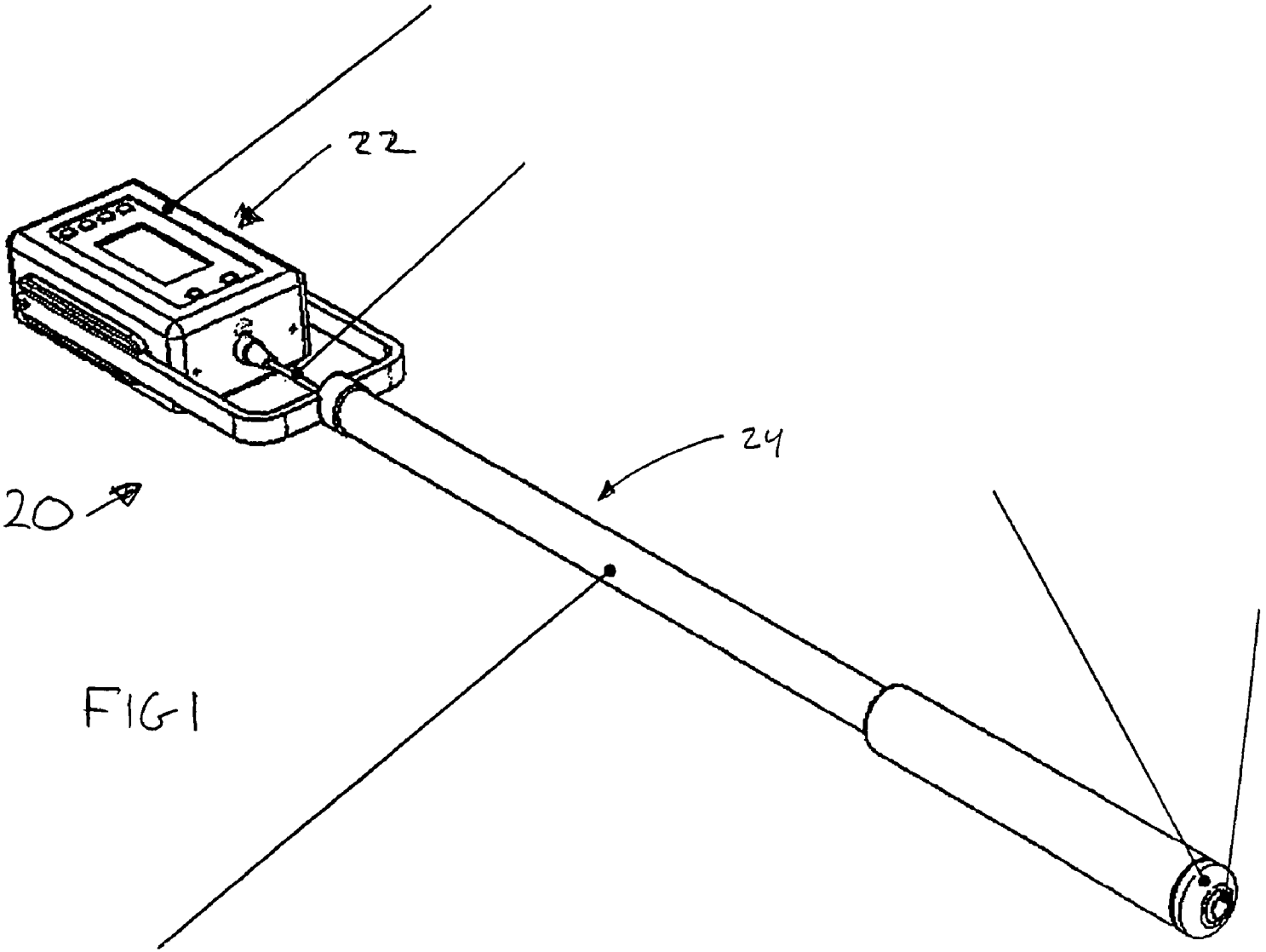
FIG. 1 is a view of a counting apparatus according to principles of the invention.
Figure 2:
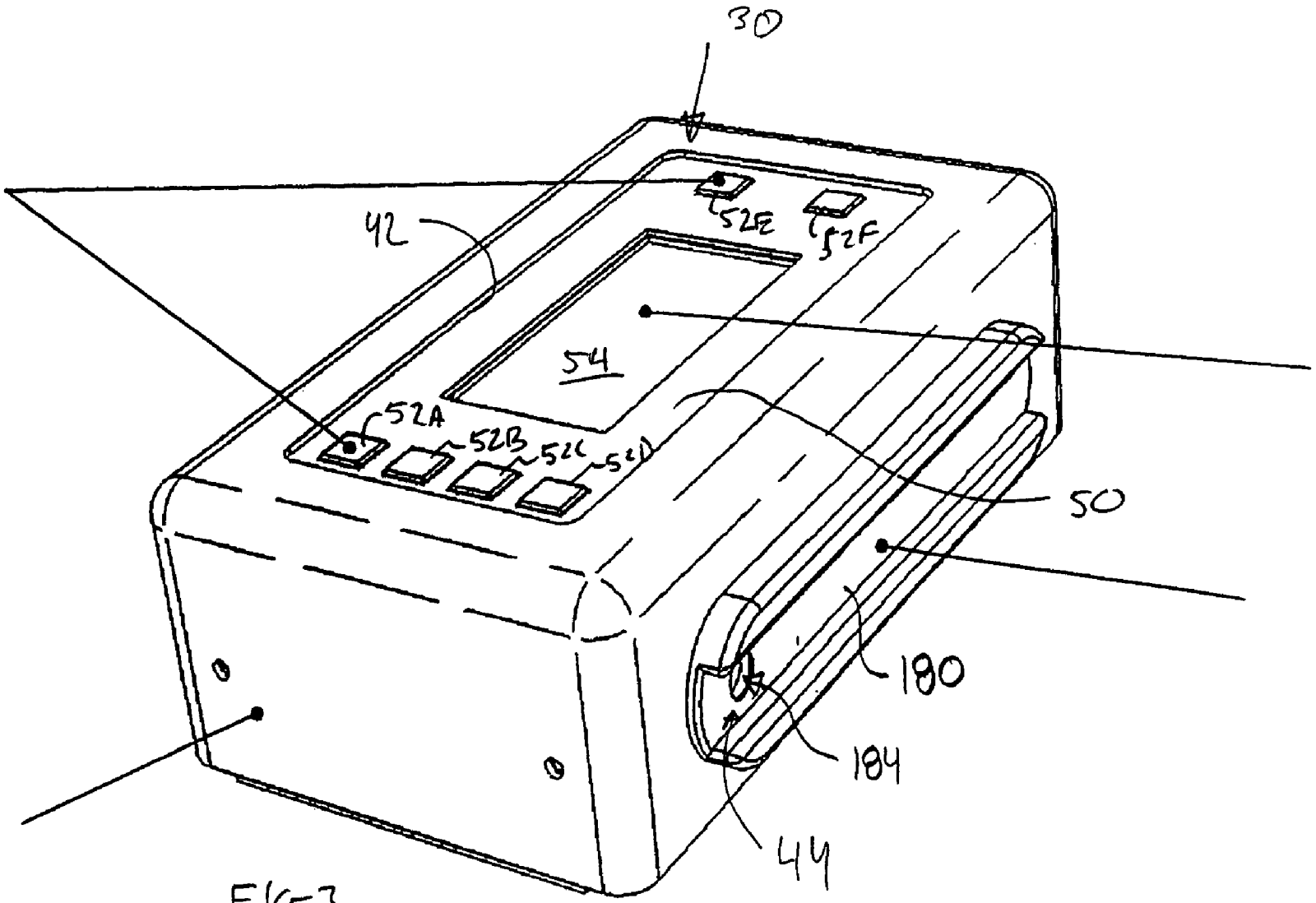
FIG. 2 is a top perspective view of a main unit of the apparatus of FIG. 1.
Figure 3:
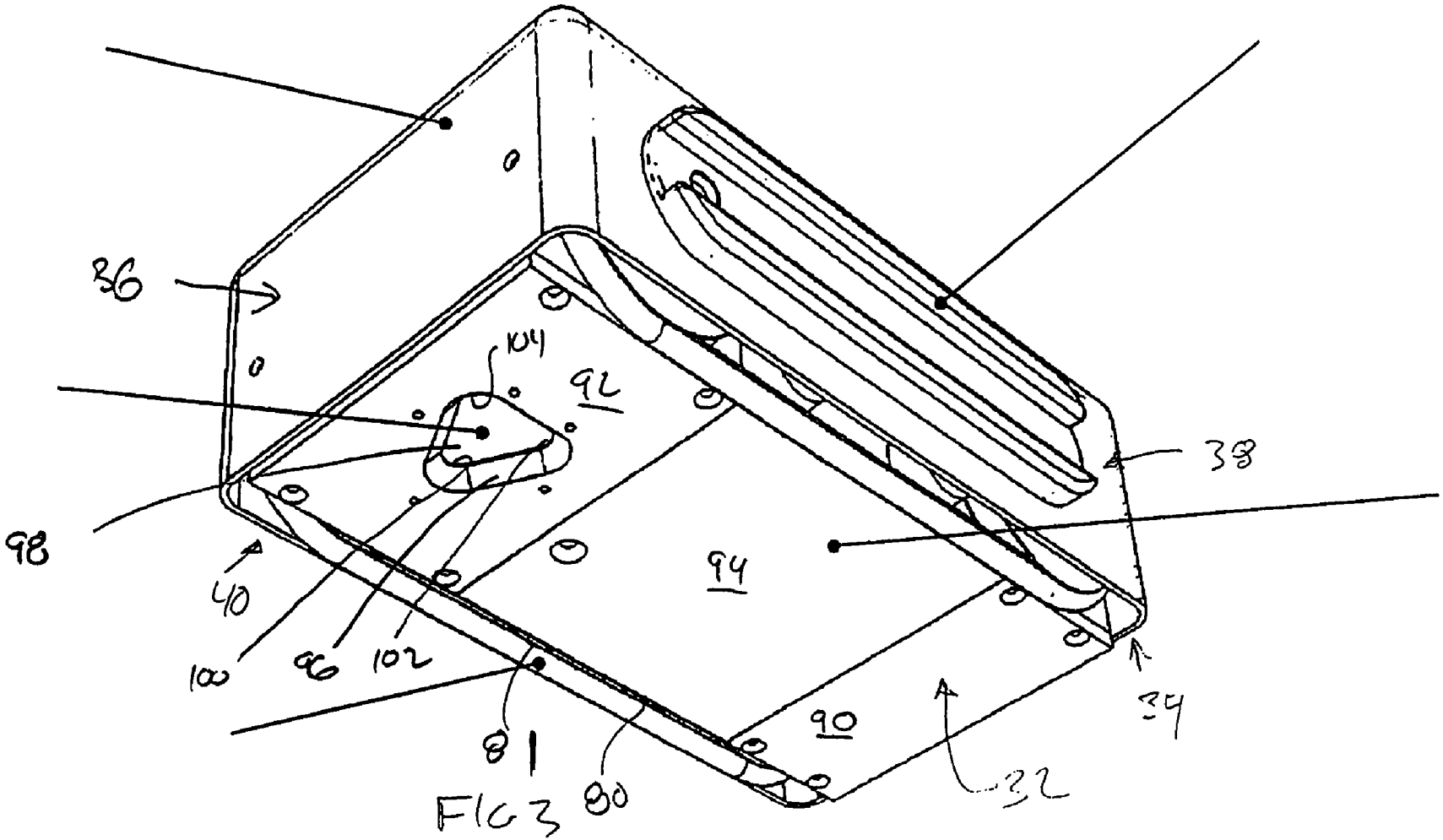
FIG. 3 is a bottom perspective view of the main unit of FIG. 2.

FIG. 1 shows a counting apparatus 20 including a main unit 22 and an extension handle 24. FIGS. 2 and 3 show the main unit 22 with the handle removed. The exemplary main unit is formed generally as a right parallelepiped with rounded corners/edges. The unit has a top 30, a bottom 32, first and second ends 34 and 36, and first and second sides 38 and 40. In the exemplary embodiment, the unit has a cover with portions generally along the sides, ends, and top, the last having surfaces defining a number of apertures. The sides have handle guides 44 described in further detail below. The exemplary cover may be molded as a single piece of plastic. The apertures expose a control panel having a number of buttons 52A–52F and a display (e.g., an LCD) 54.

Figure 4:
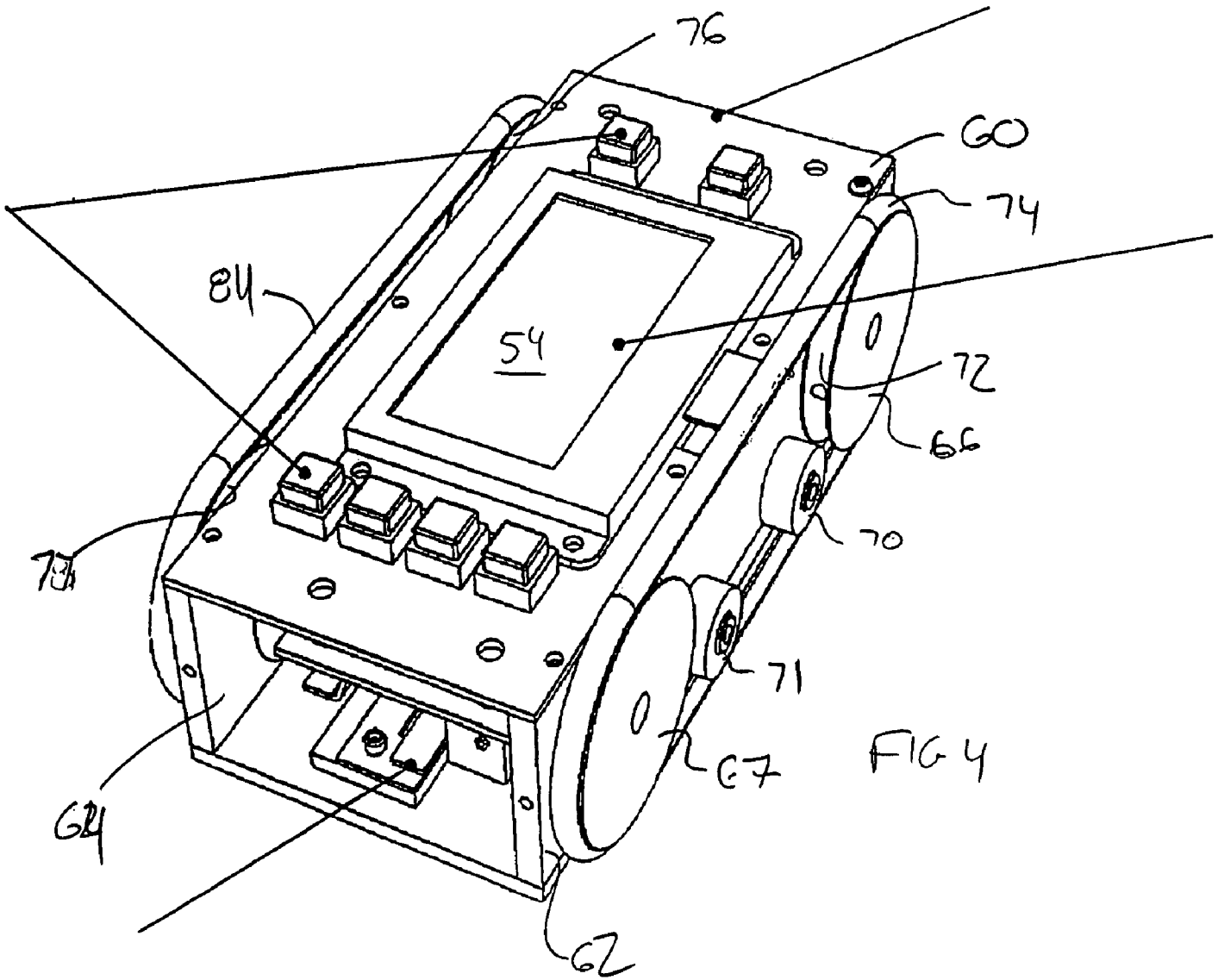
FIG. 4 is a top perspective view of the main unit of FIG. 2 with cover removed.

FIG. 4 shows the main unit 22 with cover removed. The display and buttons are shown mounted atop a display printed circuit board (PCB) 60 mounted along top edges of first and second sidewalls 62 and 64 of a chassis of the unit. FIG. 4 further shows first and second main wheels 66 and 67 mounted along the first sidewall at opposite ends of the chassis and first and second idler wheels 70 and 71 mounted therebetween adjacent a lower edge of the first sidewall. The wheels 66 and 67 each have a grooved perimeter 72. An endless loop belt/tread 74 is wrapped around the wheels 66, 67, 70, and 71. Similarly, first and second main wheels 76 and 77, belt/tread 84, and idler wheels 80 and 81 (FIG. 3) are mounted to the second sidewall 64. The idler wheels help support the device when one pair of the main wheels is unsupported.

FIG. 3 further shows the bottom 32 including first and second bottom panels 90 and 92 joining bottom edges of the first and second sidewalls along first and second ends of the main unit. Between the bottom panels, a battery door panel 94 may be located for easy battery replacement. The second panel 92 has a surface 96 defining a window aperture exposing a lower surface portion of a window 98. In the illustrated embodiment, the surface 96 outwardly diverges to form a bevel. In the exemplary embodiment, the surface 96 and aperture are oriented as a triangle with rounded corners, one corner of which is near the second side 40 and the other two corners of which are proximate the first side 38. FIG. 3 shows such first, second and third corners 100, 102, and 104 of the aperture.

Figure 5:
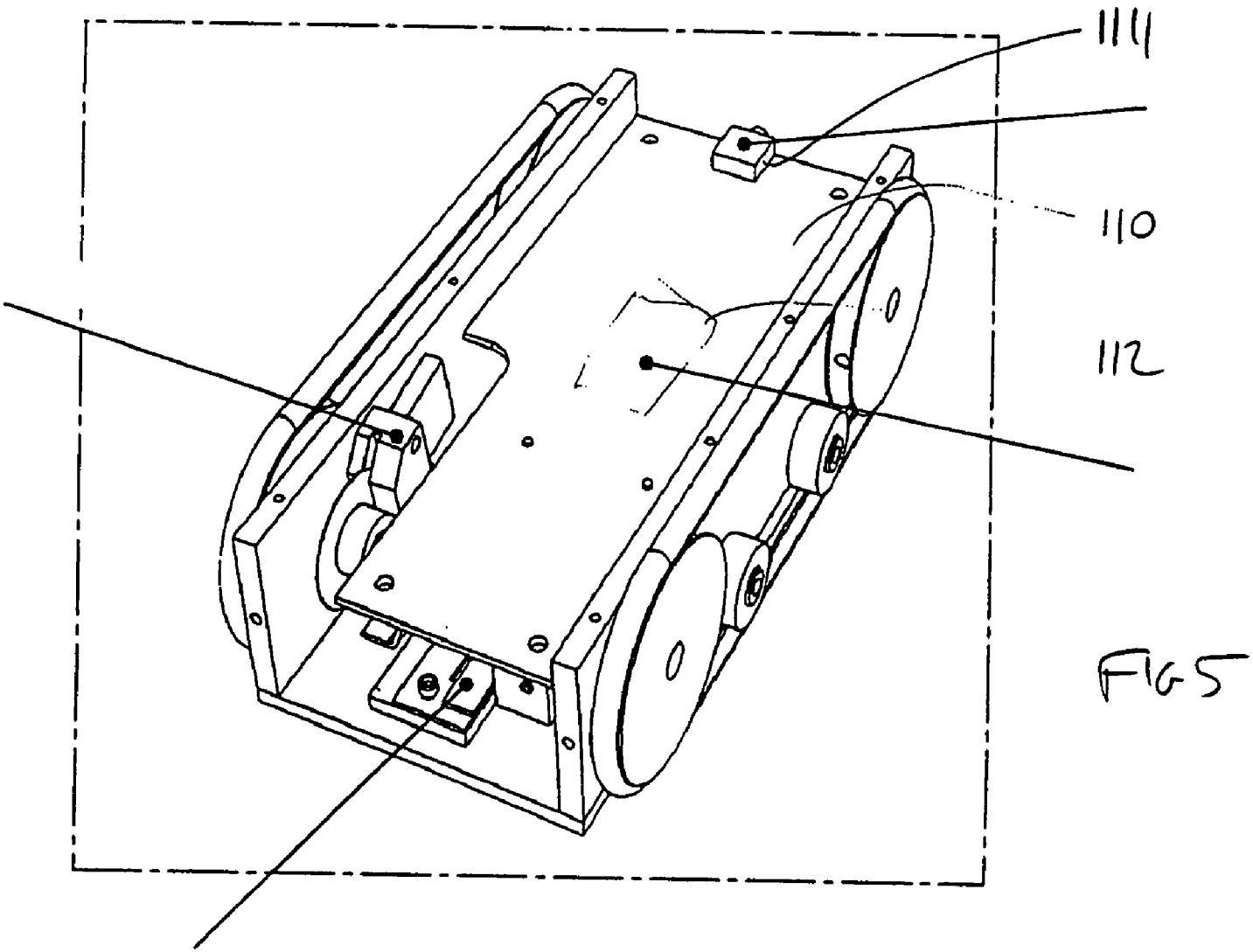
FIG. 5 is a top perspective view of the main unit of FIG. 4 with display PCB further removed.

FIG. 5 shows the chassis with display PCB 60 removed exposing a main PCB 110 on which a microprocessor 112 and related circuitry are disposed. In the illustrated embodiment, an electrical connector 114 is also located on the main PCB and is discussed in further detail below.

Figure 6:
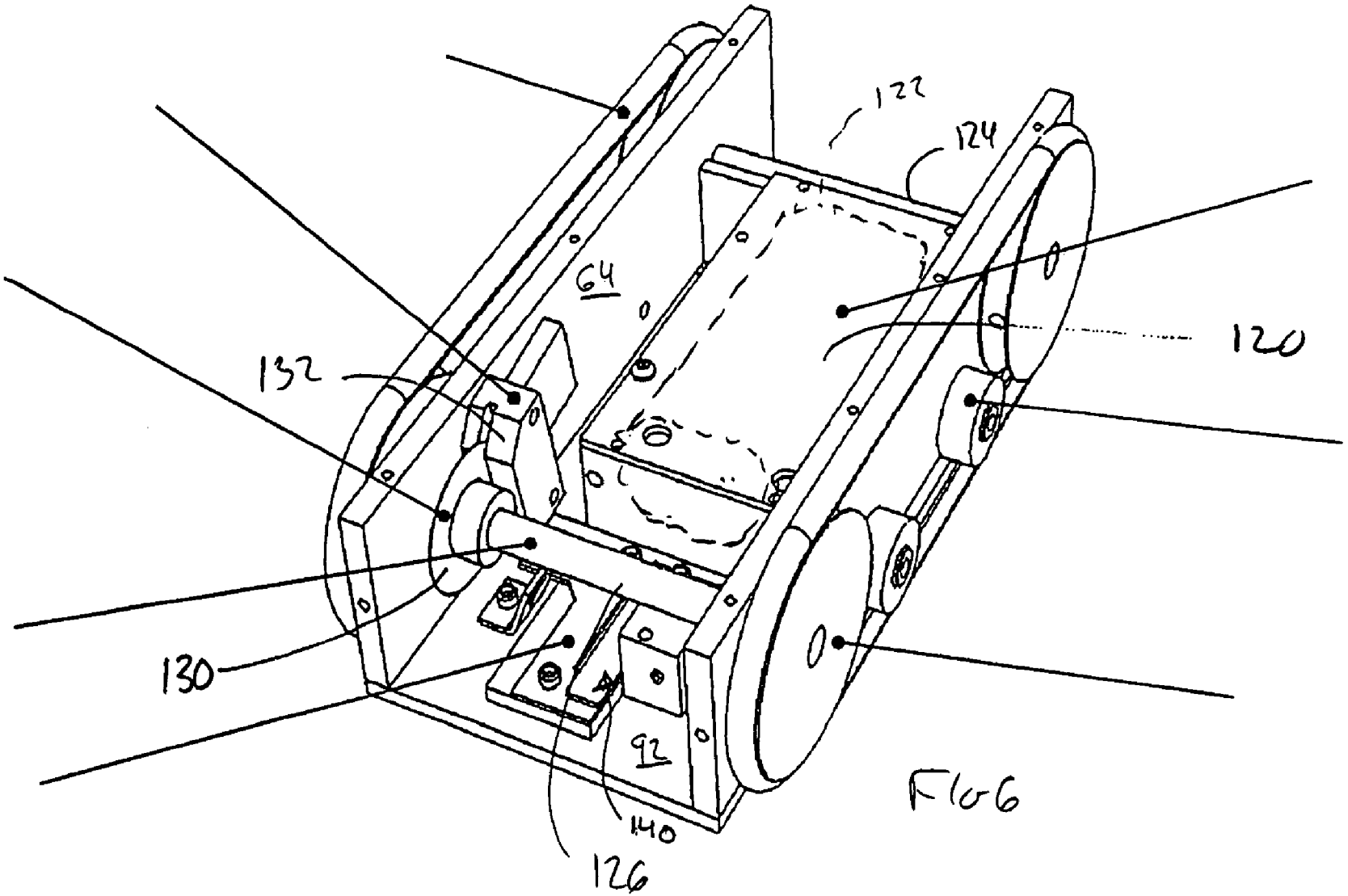
FIG. 6 is a top perspective view of the main unit of FIG. 5 with main PCB further removed.
Figure 7:
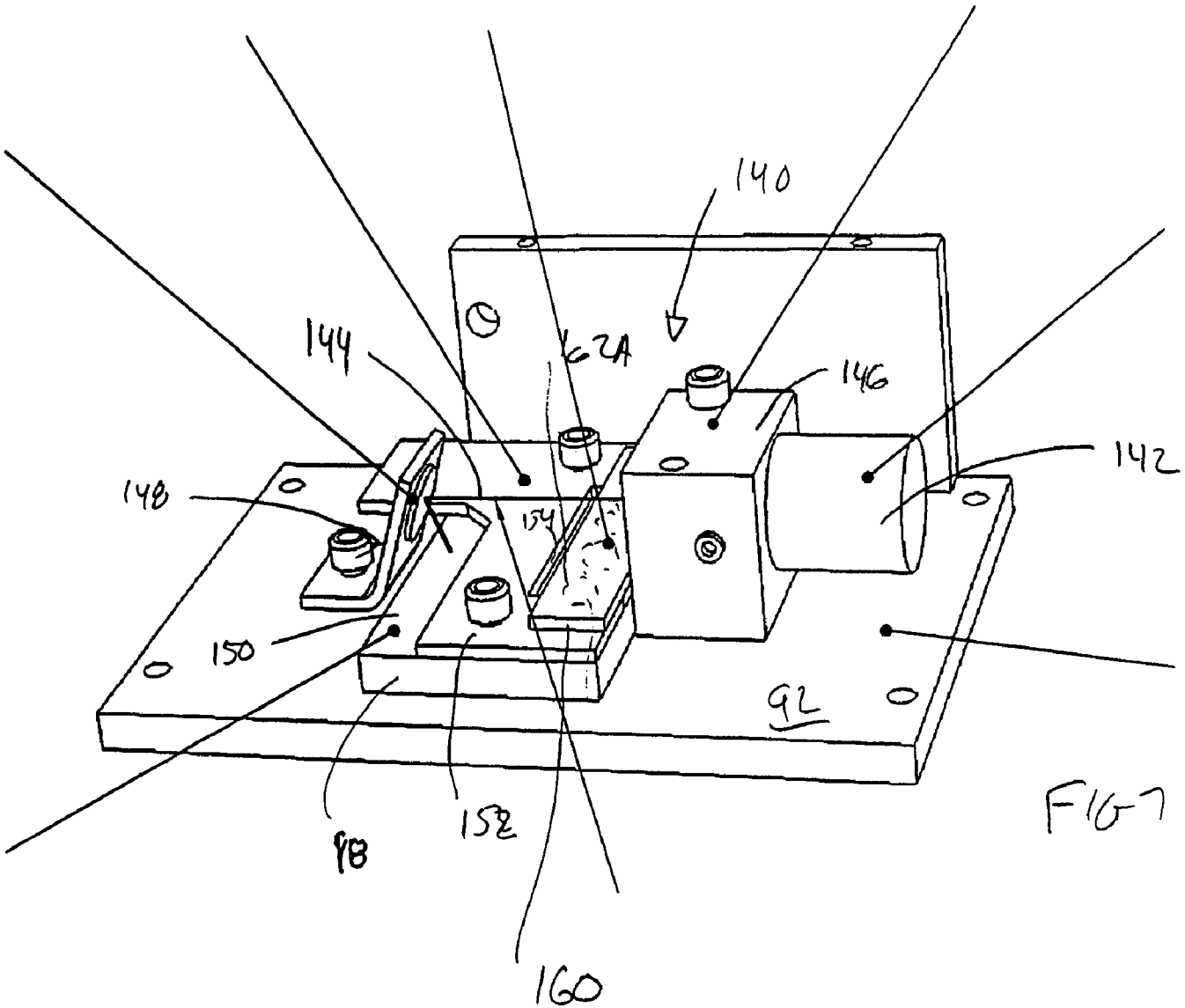
FIG. 7 is a top perspective view of an optics module of the apparatus of FIG. 1.

FIG. 6 shows the chassis with main PCB removed. A centrally-located battery compartment 120 contains one or more batteries 122 for powering the apparatus. Near the first end of the main unit, a first axle 124 connects the first main wheels and, near the second end, a second axle 126 connects the second main wheels. In the exemplary embodiment, the second axle 126 carries an encoder wheel 130 (e.g., a photomask or a perforated disk). An encoder module 132 (e.g., an optical module) is mounted to the adjacent second sidewall 64 and engaged to the encoder wheel 130 to provide an output indicative of rotation of the encoder wheel. The encoder module 132 is, in turn, electronically coupled to the microprocessor/main PCB by appropriate leads (not shown). An optics module 140 is shown mounted atop the second panel 92. FIG. 7 shows further details of the optics module. The module includes a laser diode 142 directing a beam 144 through a focusing lens system 146 mounted to the panel 92. The beam is reflected by a mirror assembly 148 also mounted to the panel 92 proximate the second side thereof. The mirror assembly reflects the beam from an initial transverse path portion to a downward portion passing through the window 98 proximate the first corner 100 (FIG. 4) of the window aperture. Centrally across the upper surface 150 of the window 98, a detector PCB 152 is mounted having a surface 154 defining an longitudinally elongate aperture coaligned with a first side portion of the window aperture between the second and third corners 102 and 104. A detector array assembly 160 is mounted across the PCB port spanning the elongate aperture and carrying a longitudinal array of detectors 162A–162G. The first detector 162A is located proximate the corner 102 and the last detector 162G proximate the end 104. Exemplary detectors are positive-intrinsic-negative (PIN) photodiodes. An exemplary ten-detector array is available from UDT Sensors, Inc., Hawthome, Calif. With such a commercially-available ten-detector array, an exemplary three detectors may remain unused.

Figure 8:
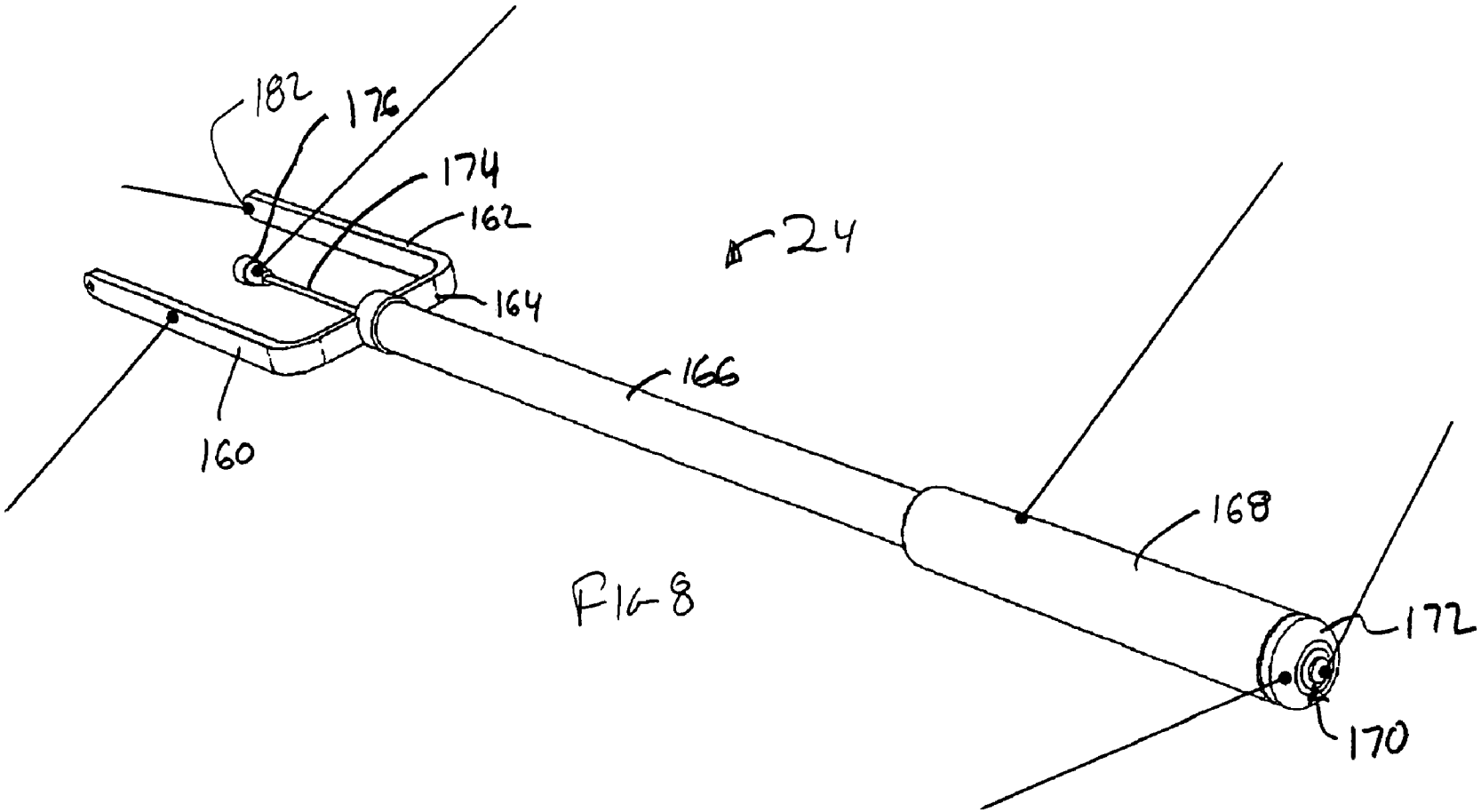
FIG. 8 is a view of a handle of the apparatus of FIG. 1.

FIG. 8 shows further details of the handle 24. The exemplary handle is formed as a fork having a pair of tines 160 and 162 extending from opposite ends of a crossmember 164. A shaft 166 extends centrally from the crossmember and terminates in a grip 168. Mounted in the grip, an input device in the form of a push button switch 170 is mounted. In the exemplary embodiment, an indicator in the form of a lighted bezel 172 is also mounted to the handle encircling the switch. A cable 174 containing electrical conductors (not shown) extends from the input device and indicator and terminates in an electrical connector 176. In the exemplary embodiment, the cable extends longitudinally through the shaft emerging from the crossmember 164. The handle may be installed to the main unit by sliding the tines along channels 180 (FIG. 2) in the guides 44 until detent projections 182 (FIG. 8) extending inward from the tines proximate their ends engage respective sockets 184 in the guides.

The connector 176 may be mated to the jack 114 (FIG. 5) to establish electrical/electronic communication between the handle and the main unit. The handle may be installed when access to the lite array is impractical for the user's hand.

Figure 9:
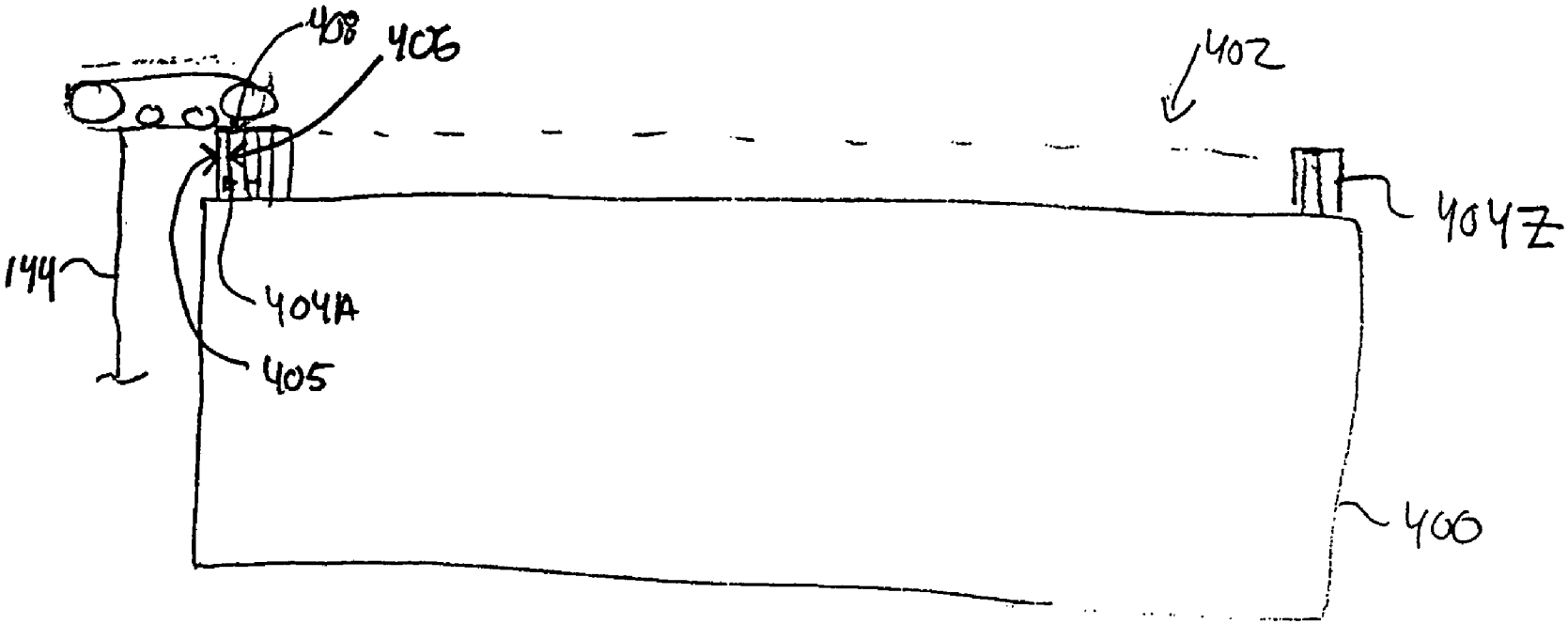
FIG. 9 is a first schematic side view of a crate of lites being counted by an apparatus in accordance with principles of the invention.

In operation, a user installs or removes the handle as appropriate to the task at hand. In an exemplary use, FIG. 9 shows a carton or crate 400 having an open top end with a protruding longitudinally-extending array 402 of lites of which the lite at the first end of the array is designated 404A and the lite at the second end is designated 404Z. For consistent reference, it will be assumed that each of the lites has a pair of opposed parallel first and second main faces 405 and 406 joined by a lateral perimeter. In the exemplary situation of rectangular lites, the perimeter is similarly rectangular, having four long thin generally flat side surfaces extending between the first and second faces and having associated intersections with such faces designated as edges. These side surfaces may typically be cut surfaces formed when each lite is cut from a larger sheet of glass. The user places the unit with the treads near the first end in engagement with the exposed sides 408 of the first few lites and presses a start button (e.g., a start/stop button on the unit or the handle).

Figure 10:
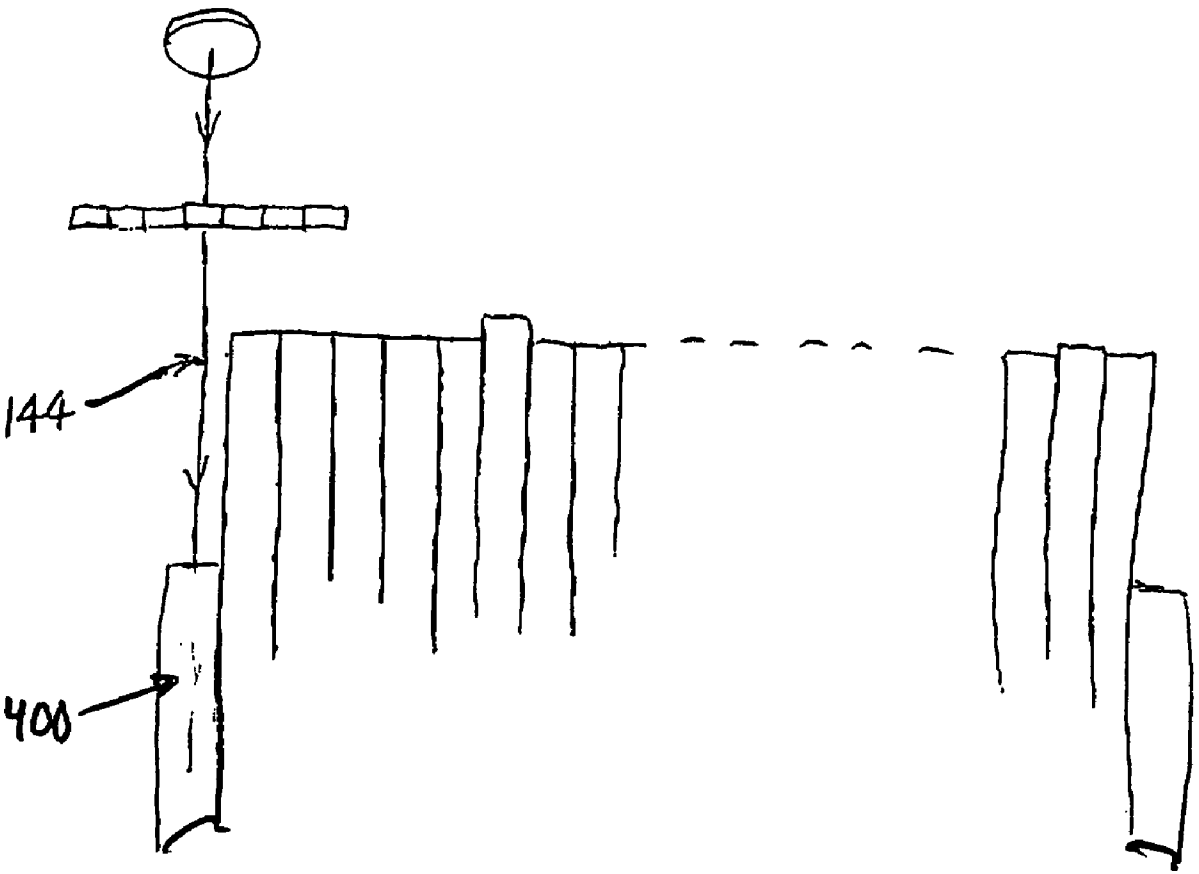
FIG. 10 is an enlarged view of the crate of lites being counted in FIG. 9.
Figure 11:
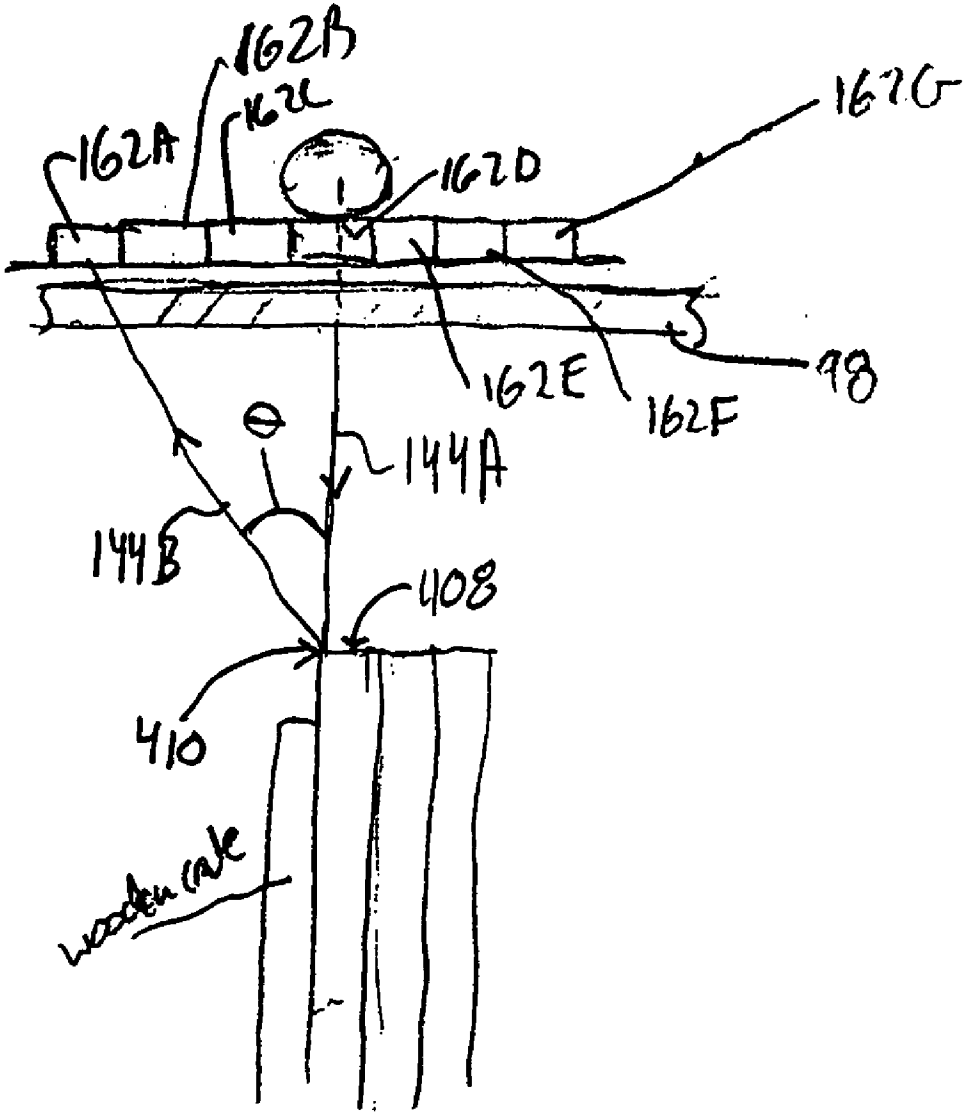
FIG. 11 is a second enlarged schematic side view of the crate of lites.
Figure 12:
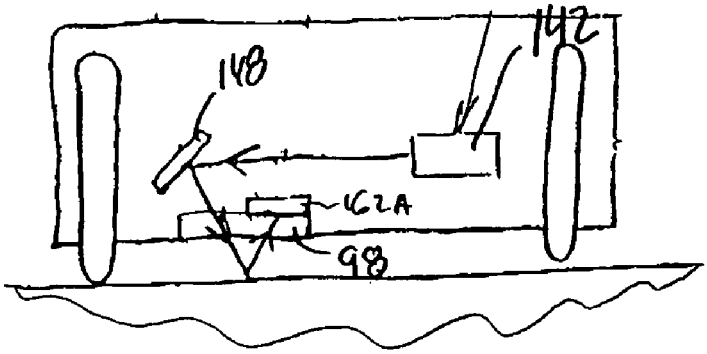
FIG. 12 is a schematic end view of the crate of lites.

At this point, the beam and at least the central detector (FIG. 10) are outboard of the first lite. The user then rolls the unit longitudinally downstream in a direction from the first lite toward the last lite. During this rolling process, engagement between the exposed lite sides 408 and the treads rotates the encoder wheel so as to provide the microprocessor with input indicative of the distance the unit has traversed. Eventually, the beam will begin to intersect the outboard (first end) extremity of the first lite. FIG. 11 shows the incident portion 144A of the beam impacting the first edge 410 of the exposed side of the first lite. During a very brief first interval, the reflected portion 144B may traverse wildly at a rapidly changing angle θ relative to the incident portion and may sweep wildly across the detector array, intersecting one or more of the detectors, especially detectors other than the central detector 162D. For simplicity of illustration, FIG. 11 ignores the effects of refraction by the window 98. FIG. 12 schematically shows an end view of the beam path. This relatively quick fluctuation (optionally in combination with additional confirmatory input for the user) may be determined by the microprocessor's programming as the start of the array and of the first lite.

Figure 13:
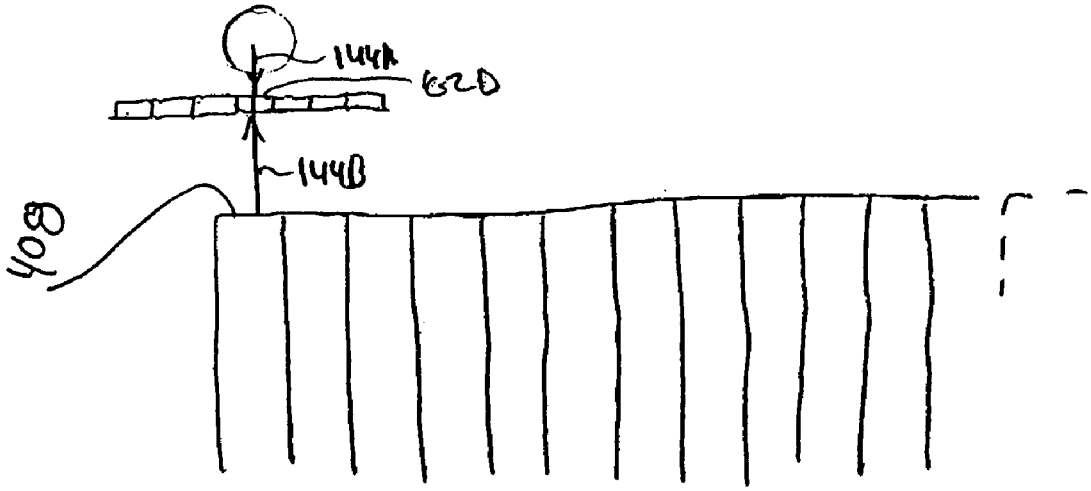
FIG. 13 is a third enlarged schematic side view of the crate of lites.
Figure 15:
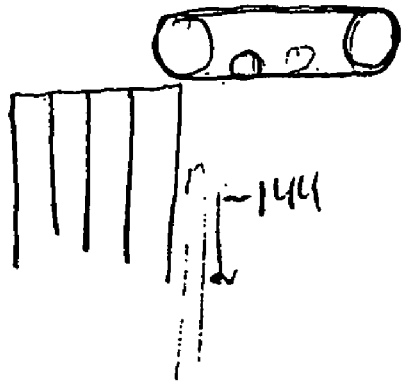
FIG. 15 is a fifth enlarged schematic side view of the crate of lites.

As the apparatus is further rolled, the incident beam will intersect the exposed side 408 of the first lite (FIG. 13). The resulting specularly deflected beam 144 will ideally tend to impinge the central detector 162D. There may be less than ideal situations. For example, if the cut side is not perpendicular to the lite faces or if the array is slightly racked, the side surface will not be parallel to the direction of traversal and, therefore, may reflect the beam slightly off center. In such a situation, the beam may relatively consistently impinge one of the other detectors (especially one near the center) or more than one of the detectors (e.g., if impinging upon the intersection of two detectors). Minor dispersion may also cause the beam to impact a small group of detectors. This condition will generally continue until the incident beam portion reaches the second edge of the first lite. This second interval of lite impinging the side is very much longer than the interval of lite interacting with the edge. During this second interval, minor undulations in the exposed side surface may cause the reflected beam portion to migrate to one or more other detectors. Such migration will typically be long (slow) relative to the first interval and short relative to the second interval (of which it is merely a subinterval). Accordingly, in view of speed of traversal data provided by the encoder, reflected beam angle changes due to surface irregularity can be distinguished from those due to lite edges.

Figure 14:
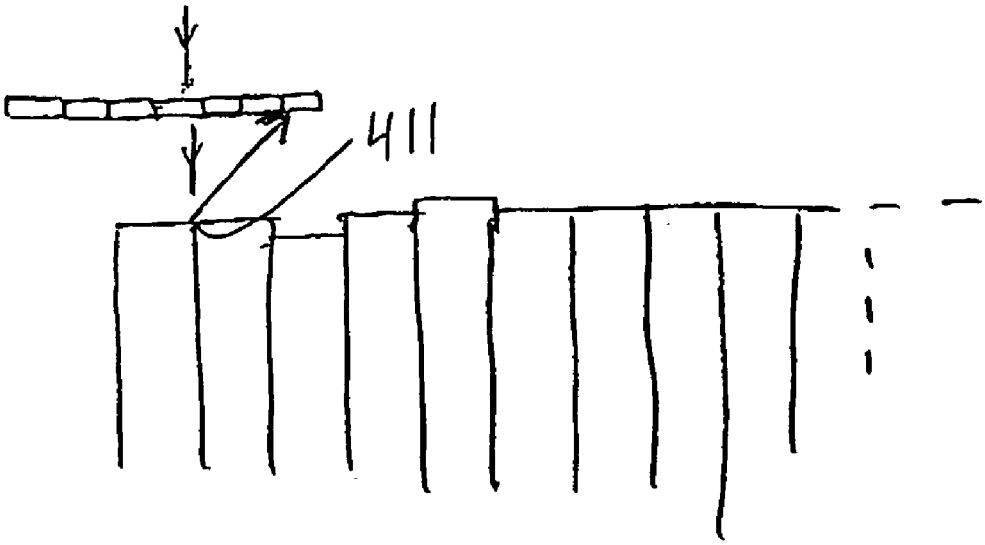
FIG. 14 is a fourth enlarged schematic side view of the crate of lites.

Subsequently, the incident beam will reach the second edge 411 of the first lite exposed side which may be substantially coincident with the first edge of the second lite exposed side as shown in FIG. 14 if the two lites are abutting. These one or two edges may produce a similar interval of erratic reflection as in FIG. 11. Because the time interval between the conditions of FIGS. 11 and 14 may be reconciled with input from the encoder, a nominal lite thickness may be calculated based upon the distance traversed by the apparatus between these two conditions as determined by the encoder. A similar change will occur for each subsequent lite. Eventually the beam 144 will pass beyond the second edge of the exposed side surface of the final lite 404Z which will produce a final varying reflection. After that, the user may press the start/stop button confirming the end of traversal or the long interval of no reflected input to the detectors may cause the microprocessor to automatically make this determination. At this point, the microprocessor will cause the final lite count to be displayed on the display.

Figure 16:
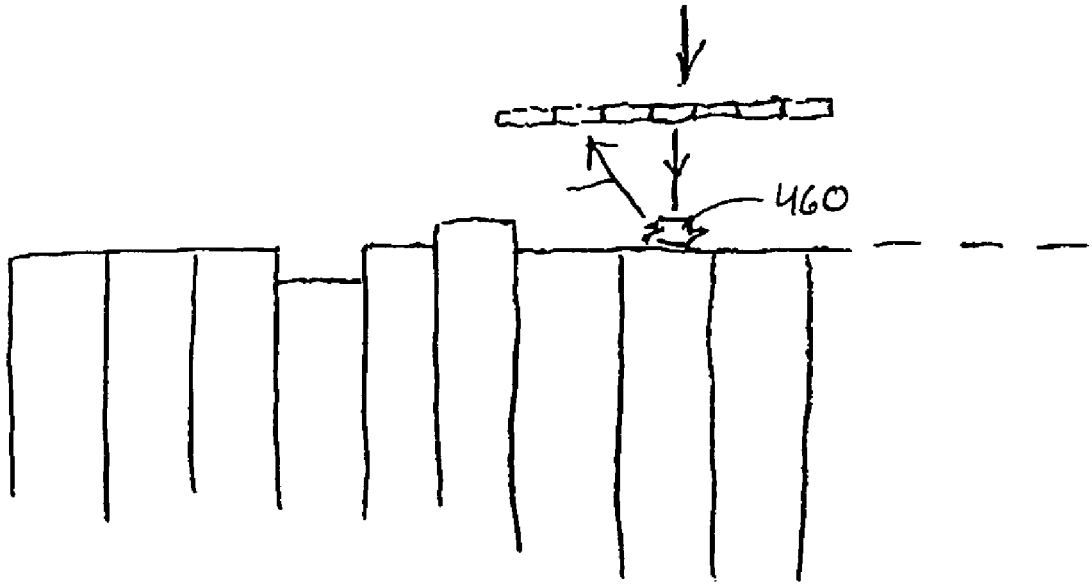
FIG. 16 is a schematic side view of debris on lites being counted.

A number of additional conditions may need to be addressed. Certain factors may cause a rapidly varying reflected beam which is not associated with a lite edge. For example, a debris chip 460 (FIG. 16) atop an exposed lite side may produce one or more brief intervals of varying reflection similar to the intervals associated with an edge. This can be detected by software in the microprocessor and ignored. For example, based upon the encoder input it may be determined that the varying reflection occurs at a fraction of the expected lite thickness based upon previously-recorded intervals. This may further be verified if the interval between: (a) a rapidly varying reflection subsequent to the questionable reflection; and (b) a varying reflection prior to the questionable reflection does correspond to the expected interval.

Figure 17:
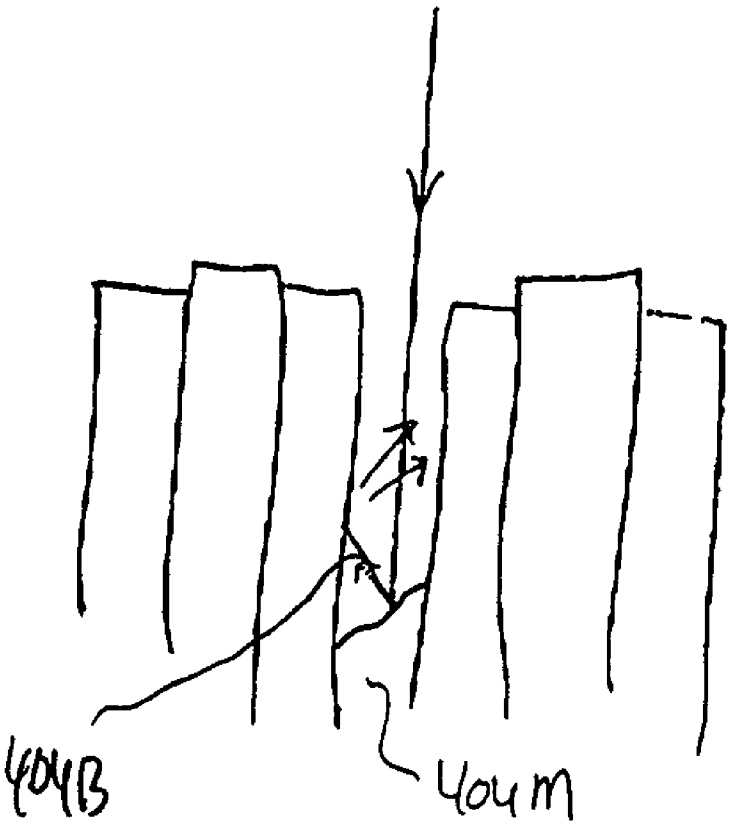
FIG. 17 is a schematic view of a broken lite in an array of lites being counted.

Other conditions may be associated with the lack of an expected return reflection. In a first example, the exposed sides of two adjacent lites are very cleanly cut and precisely aligned so as to create one essentially smooth continuous surface. In such a situation, the adjacent edges may not produce highly varying reflection as the beam scans across their junction. Thus the second interval is effectively doubled as seen by the microprocessor. If this condition is detected to be within a given window of twice the expected second interval, the processor's software can cause the microprocessor to nevertheless correct and increment the counter. In another situation, FIG. 17 shows a lite 404M whose exposed side portion is broken away, leaving an irregular exposed side recessed substantially below the exposed sides of adjacent lites. The reflected beam portion 404B may not escape this recess to provide effective detector input. In such a situation, an interval of no input would occur between the brief rapidly varying input intervals provided by the edges of the exposed sides of the two adjacent lites. The detection of this no input (null) interval, in combination with: (a) the brief adjacent rapidly varying intervals caused by the adjacent edges of the adjacent lites; and (b) the adjacent more constant intervals associated with reflections from the sides of such adjacent lites could cause the microprocessor's programming to identify the presence of such a broken lite. The counter could be incremented to count the broken lite or, if it is not desired to count broken lites, the counter could not be incremented or a separate counter identifying broken lites incremented. This condition could be distinguished from the situation of a gap between adjacent lites. A distinguishing factor could be that the null interval is within a given window of the expected second interval. A smaller or large null interval might be treated as a gap. The software may further be programmed for other situations including hybrids of the above such as a partially broken away exposed side.

More catastrophic situations may be provided for. For example, there may be situations where there are large gaps in input such as if the apparatus is rolled over a label obscuring a group of the exposed sides. The apparatus could display an error message indicating that the user should traverse again and potentially indicating a particular course of action or cause of the error. For example, in the identified label situation the apparatus may instruct the user to traverse at another location. Similarly, an extreme debris presence may produce excess varying inputs. The error message in such a case could suggest the user clean the lite array of debris.

Figure 18:
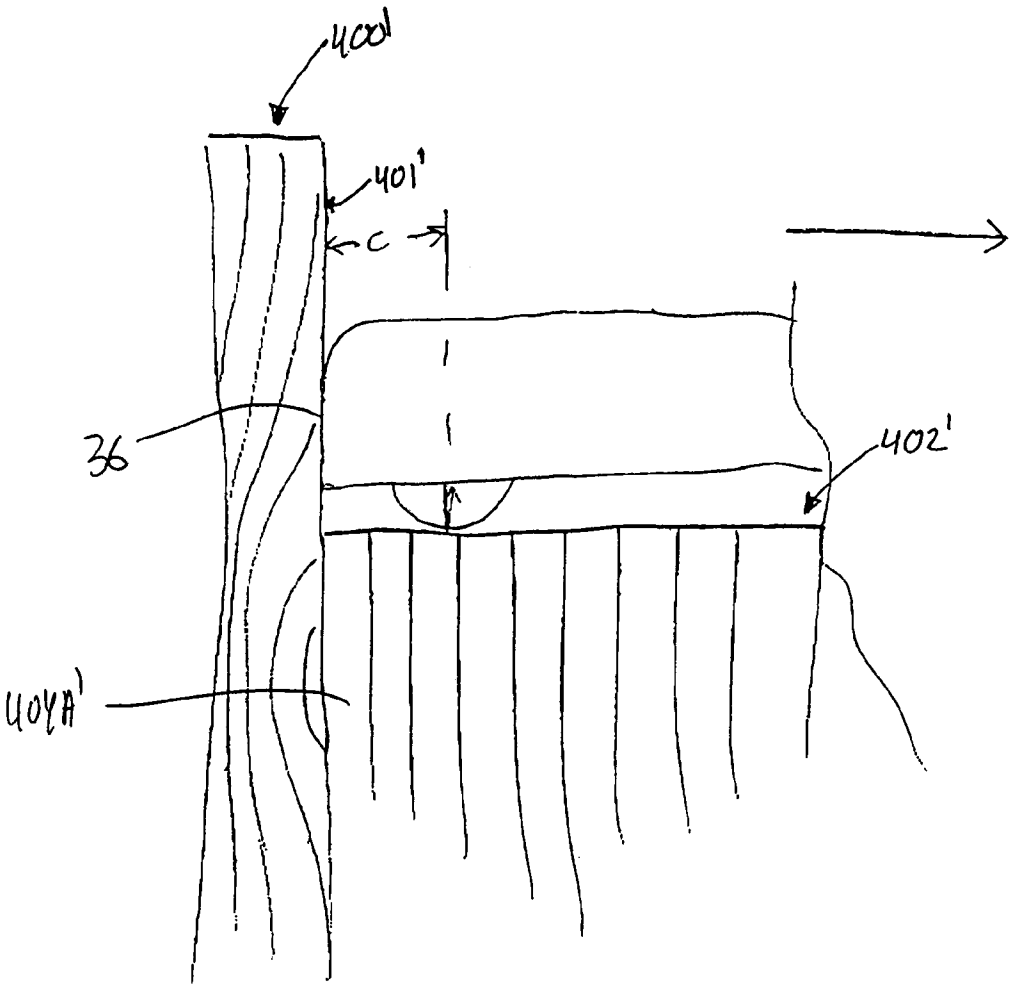
FIG. 18 is a schematic side view of a second crate of lites being counted.

Various provisions may be made for situations of limited accessibility of the array. FIG. 18 shows a crate 400' containing an array 402'. The sidewall of the crate immediately adjacent the first surface of the first lite 404A' protrudes above the exposed side surfaces of the array, thereby preventing a full traversal. The apparatus is placed atop the array with its second end 36 abutting the interior surface 401' of that sidewall. There is known longitudinal spacing C between the second end 36 and the longitudinal position of the beam (more particularly the longitudinal location where the beam is expected to impact the lite side surfaces). The user presses the start/stop button and then begins traversal. The apparatus will detect edge reflection conditions and normal side reflection conditions as discussed above. Based upon a lite thickness (e.g., as calculated during the traversal) and the longitudinal spacing C, the microprocessor may calculate the number of lites at the beginning of the array which were missed and may add such an amount to the counter. A similar compensation may be used at the other end of the array if necessary. The compensation may be automatic (e.g., if movement starts or stops) in a normal side reflection condition or may be triggered by user input such as multiple clicks of the start/stop button.

Figure 19:
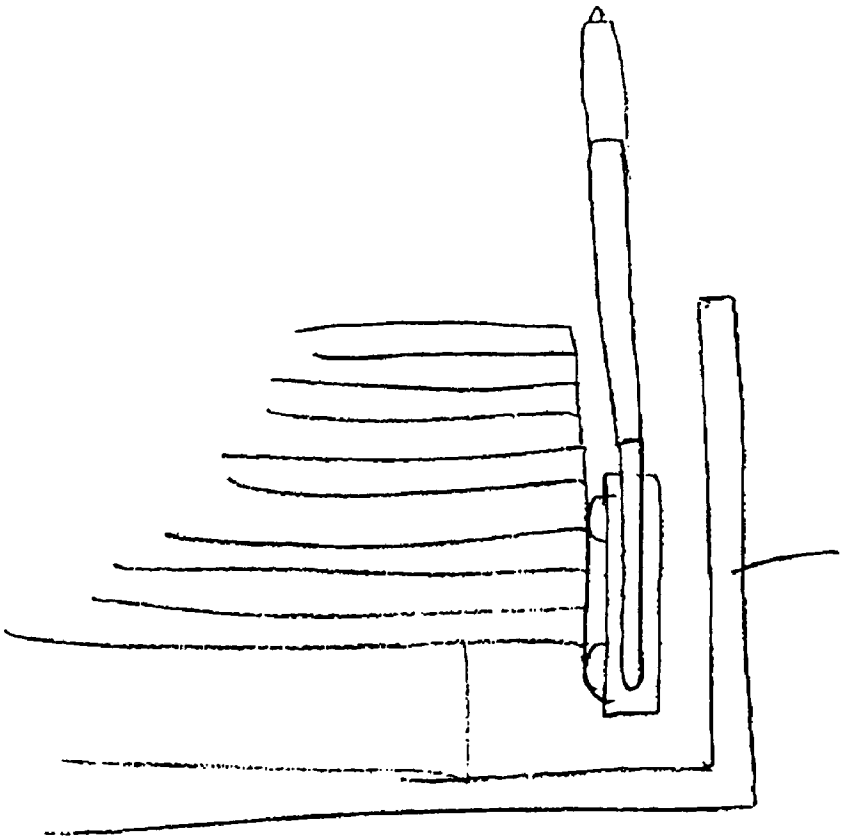
FIG. 19 is a partially schematic sectional view of a third crate of lites being counted.

FIG. 19 shows the apparatus with handle attached for counting lites in a situation wherein some environmental obstacle (e.g., a crate sidewall for vertically-stacked lites) prevents access by the user's hand.

Figure 20:
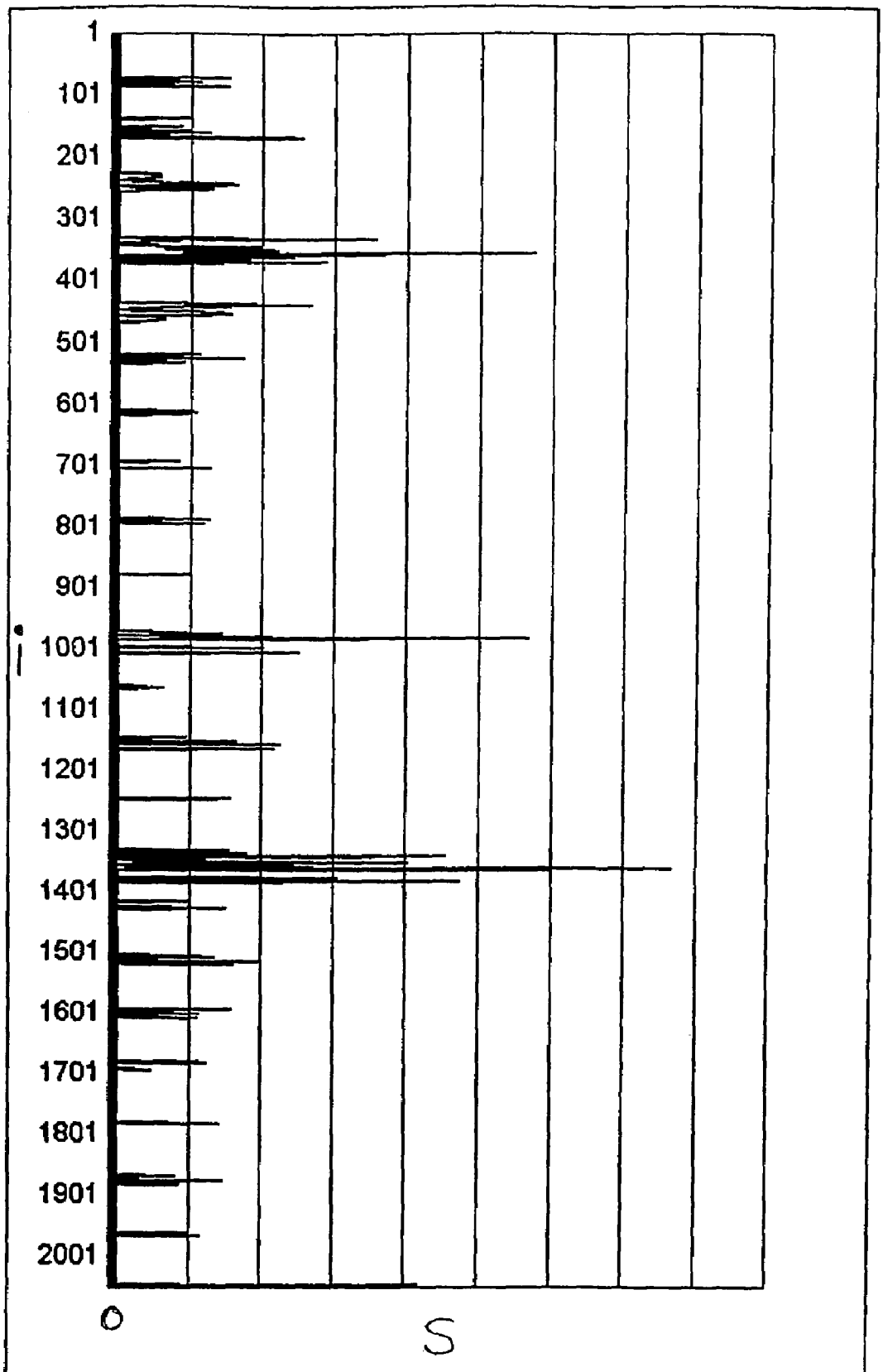
FIG. 20 is a graph of summed filtered detector output differences against apparatus position.
Figure 21:
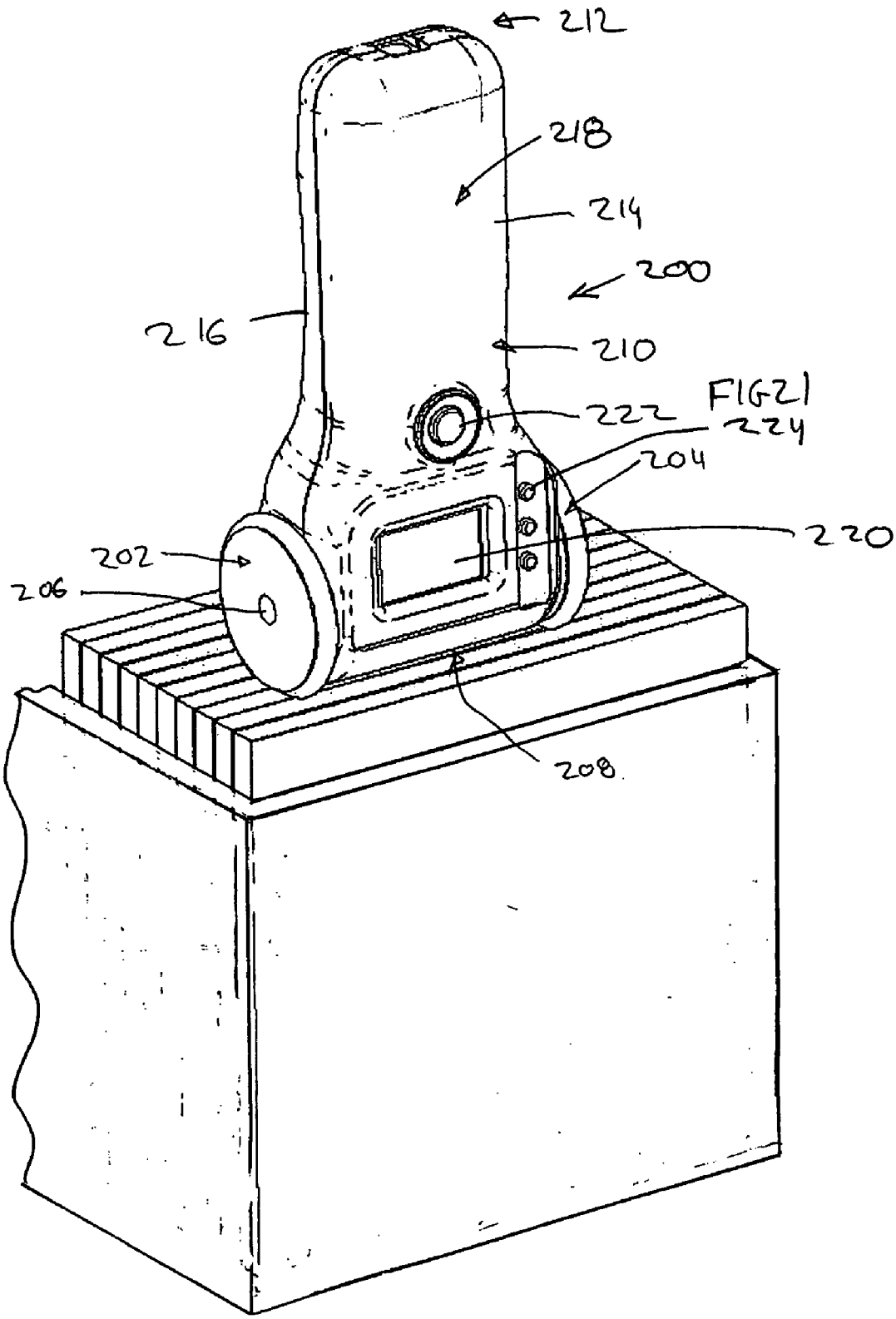
FIG. 21 is a view of an alternate counting apparatus.

Various particular hardware and software implementations may be selected to implement the some or all of the aspects of the general methods described above. In an exemplary implementation, the encoder pulse interval is used to time a processing cycle. An exemplary interval is associated with a tenth of a millimeter of traversal. A given scan may be initiated by pushing the start/stop button and rolling the unit forward along the array or merely by the latter. When the beam first strikes a lite, one or more of the detectors should be illuminated by the return. With detector(s) so illuminated, the next encoder pulse may trigger further activity by the microprocessor. In the exemplary implementation, this involves a preprogrammed comparison/contrasting of detector signals. For example, a 256-value digital converted signal is received from each of the exemplary seven detectors. These seven detectors provide one fewer pairs of detectors. For each of the six pairs, the absolute value of the difference between the two associated signals is determined. The data can be identified by: (1) the particular encoder pulse "i" ranging from 0 (with a value of "d" being the first pulse after the first received reflection) to a very large number (e.g., thousands); (2) the particular pair "k" (for the exemplary seven detectors k being one to six); and (3) the absolute value "s" (e.g., 0–255). The values of s may be further scrutinized. If any s fall below threshold values, they may be reset to zero and ignored. The threshold values may be particular to the given detector pair. For example, the inner pairs (k=3, 4) might have a relatively high threshold value (e.g., fifteen) while the threshold may decrease toward the outer pairs. An exemplary threshold for the outermost and intermediate pairs is three. The s values (if greater than the associated thresholds) are summed for a given i to yield a sum S. FIG. 20 shows an exemplary graph of the sum S values against i. One can clearly identify the junctions between lites with the first lite starting at an i value of about seventy.

The unit may update the lite thickness "n" measured in encoder pulses. An initial value of n, if present, may be based upon a number of sources: direct user input (e.g., by selecting a number of pulses or a given type of lite associated with such number); a value stored from one or more previous scans; and/or any other default value. An exemplary system for verifying n smoothes the sum S of filtered s values for each encoder pulse. In an exemplary smoothing, the smoothed value S' is defined as the average of S for that pulse and the two pulses immediately preceding and the two pulses immediately following. Other weighting are possible.

After the counter has reached a value of i=3n+d, a test is performed: if S' is non-zero at i=3n+d, a further test is performed. In the further test, the microprocessor looks for further non-zero S' at expected intervals (e.g., at three prior look back points of i=2n+d, i=n+d, and i=d). If there are non-zero S' in a sufficient number of these intervals (e.g., two of the exemplary three) that value of i is identified as belonging to a cluster pattern. The test is then repeated for the next value of i (i.e., i=3n+d+1), the associated look back points being similarly incremented. The test may be repeated for every new value of i. The test serves to eliminate clusters which result from debris or defect rather than the edge of a lite or the adjacent edges of two lites.

A parallel computation may be performed to modify the value of n in response to the identified cluster patterns. For various reasons, the initial value of n might not represent the exact or apparent lite thickness. For example, the lites might be racked, producing a cosine error so that the apparent thickness differs from an otherwise accurate n. There also may be manufacturing tolerance issues or other batch-to-batch variations. The distance in encoder pulses from the center of each identified cluster in a cluster pattern to the center of the next cluster may be averaged and compared with n. The average may be used to correct n. The correction may be subject to appropriate error correction algorithms to insure that unusual short term cluster patterns do not inappropriately influence n. In some cases there may be no initial value of n or, the initial value may be incorrect. A value may then be more rapidly calculated. For example, if the initial value is sufficiently incorrect no clusters might be identified. If, by the time the unit has scanned to a given threshold (e.g., i=5n+d) and no clusters have been identified, it may be assumed that the initial value of n is invalid. The microprocessor uses an appropriate algorithm (e.g., the method of least squares) to establish n. During this procedure, the unit advantageously stores data (e.g., raw data or partially processed data such as S or S'). When a more appropriate initial candidate value for n is established, back processing of the buffered data may occur and, along with the forward processing of subsequent data can yield a lite count based upon a stored running sum of the clusters in the cluster pattern(s). Such back processing may alternatively be deferred until the end of the traversal.

If the buffer is exceeded before a proper candidate n is determined, a number of options are possible. Certain options involve extrapolating lite counts based upon the length of traversal in an area of lost data. Others involve continuing the traversal to merely further update and refine n. At the end of such a traversal, the display may provide a "count again" message. The user will then retraverse the lite array with the unit. However, this retraversal will utilize the refined n and, therefore, should produce a displayed count. The value of n or other thickness indication may also be displayed. A similar full or partial traversal may, in other situations, be appropriate for initialization of n.

As noted above, there may be additional corrections for additional conditions. In certain situations, the edges may fail to produce sufficient values of s because of unusually smooth features in the vicinity of the edge. The return of light indicates that one or more lites are present but the clusters are not being identified. The clusterless interval may be measured in encoder pulses and divided by n to compensate. The resulting value may be used to further increment the counter. However, if the interval is not sufficiently close to an integral multiple of n, or if the interval is larger than a threshold multiple of n (e.g., three), an error message may be displayed indicating a need to rescan.

At the end of the array, the accrual of data and identification of clusters may continue until: the returned lite falls to another level; and the encoder ceases incrementing. Normally, the second edge of the last lite would be identified as a cluster. If it is not so identified, it may still be noted due to the presence of returned lite encountered by at least one detector over the last interval of n pulses. As with intermediate and beginning situations, if the junction between the last two or more lites is also missed as a cluster, these lites may be counted due to the presence of a signal over the associated multiple of n.

FIGS. 21–25 show an alternate apparatus 200. The exemplary apparatus 200 has only a single pair of wheels 202 and 204 on a common axle 206 proximate a first end 208 of a body 210 extending to a second end 212. The body includes a housing or cover having first and second main portions 214 and 216 joined essentially along a laterally extending longitudinal plane of the apparatus 200. Exemplary wheels 202 and 204 include molded plastic hubs and elastomeric non-pneumatic tires. In the exemplary apparatus 200, a portion of the body 210 near the second end 212 forms a handle region 218 for gripping by a single hand of a user. The apparatus 200 has a display 220, a start/stop button 222, and menu buttons 224 which may function in a similar fashion as do analogous elements of the first apparatus 20.

Figure 22:
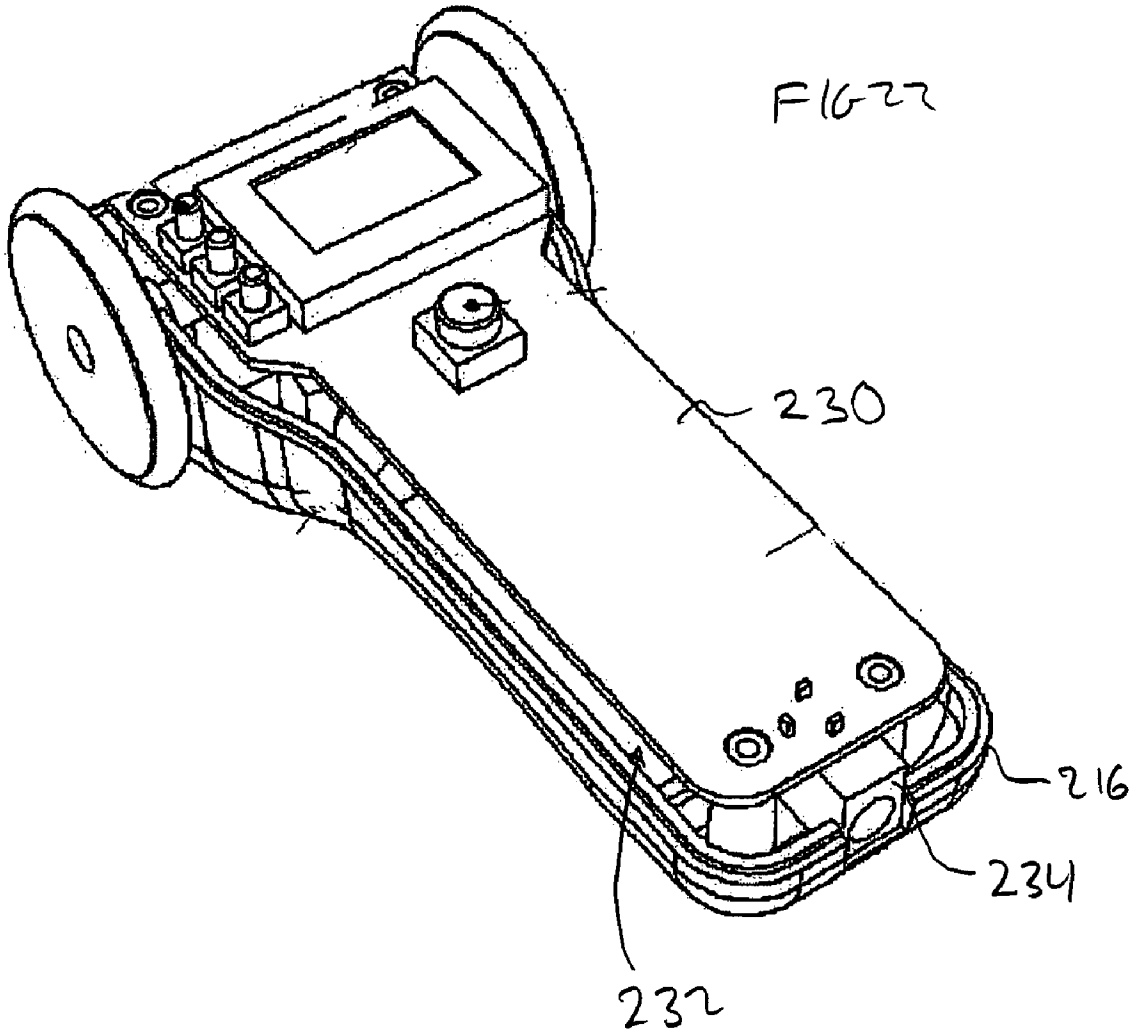
FIG. 22 is a view of the alternate apparatus of FIG. 21 with a first housing element removed.
Figure 23:
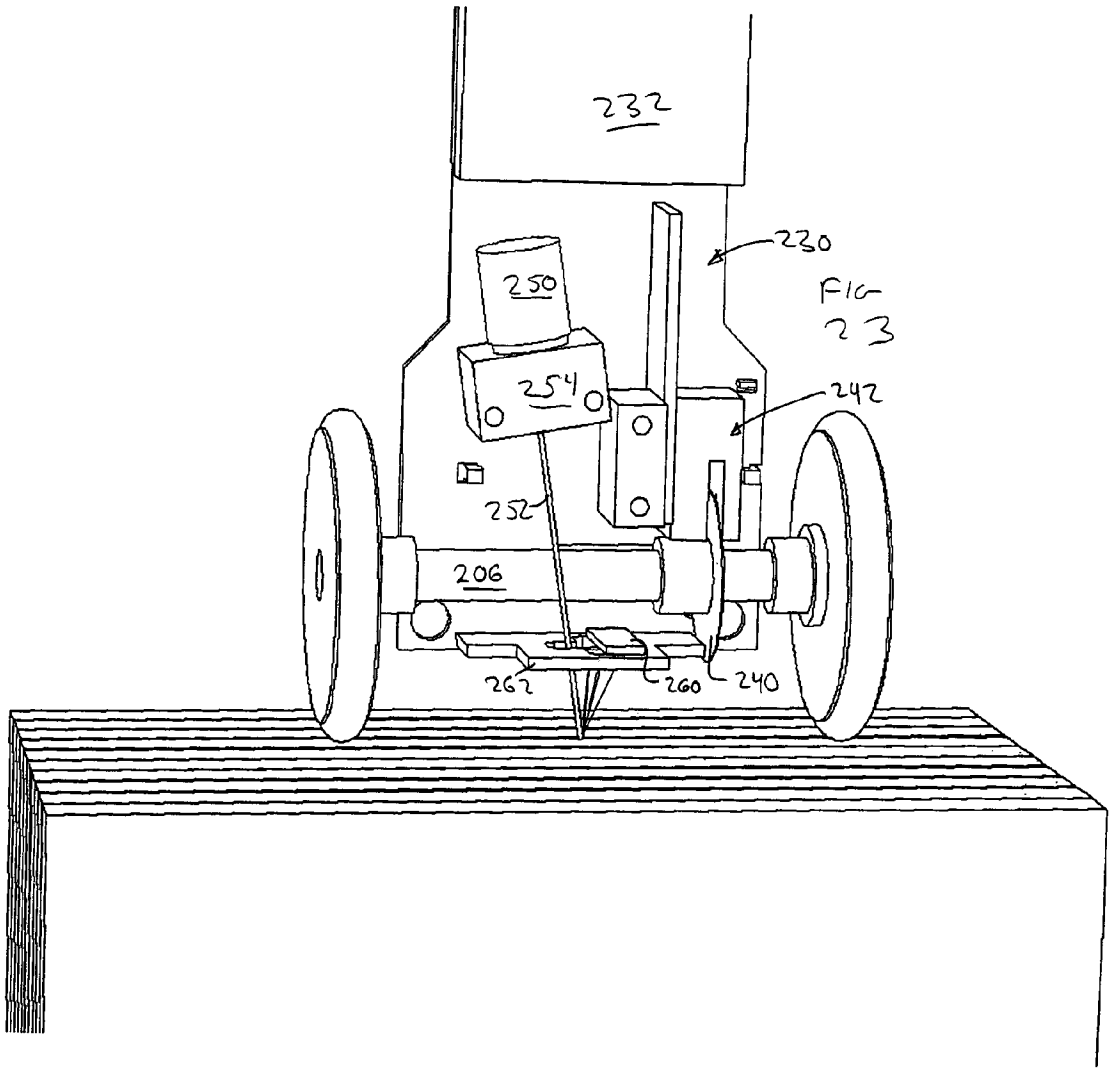
FIG. 23 is a view of the alternate apparatus of FIG. 21 with first and second housing elements removed.
Figure 24:
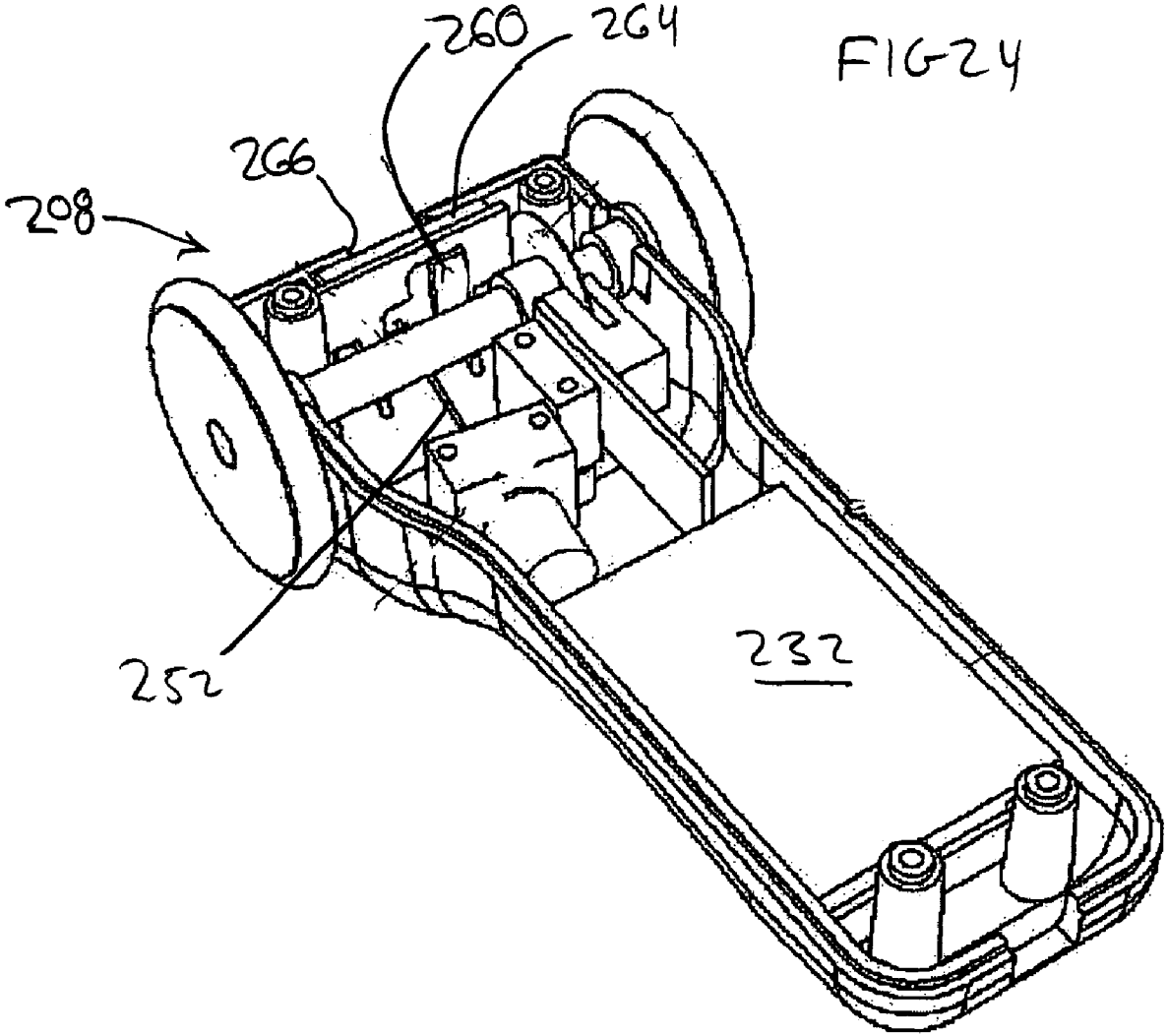
FIG. 24 is a view of the alternate apparatus of FIG. 21 with just the second housing element removed.

FIG. 22 shows the apparatus 200 with the housing portion 214 removed to show a circuit board 230 onto a first side of which the display and buttons may be mounted. A microprocessor (not shown) and associated circuitry may be mounted on one or both sides of the circuit board 230. To the opposite side of the exemplary microprocessor board 230, the second housing element 216 may contain a rechargeable battery 232. FIG. 22 further shows a recharging and DC power supply connector 234 mounted on the board at the body second end. FIG. 23 shows the axle 206 positioned adjacent the underside of the circuit board 230 and carrying an encoder wheel 240 which interacts with an encoder module 242 mounted on the underside of the board 230. Also mounted on the underside of the board 230 is a laser diode 250 directing a beam 252 through a focusing lens system 254. After impacting on the lite array, the reflected beam impacts a detector array 260 which may be mounted on an apertured support plate 262. A transparent window pane 264 (FIG. 24) may be positioned across an aperture 266 in the first end 208 to pass the incident and reflected beams.

Figure 25:
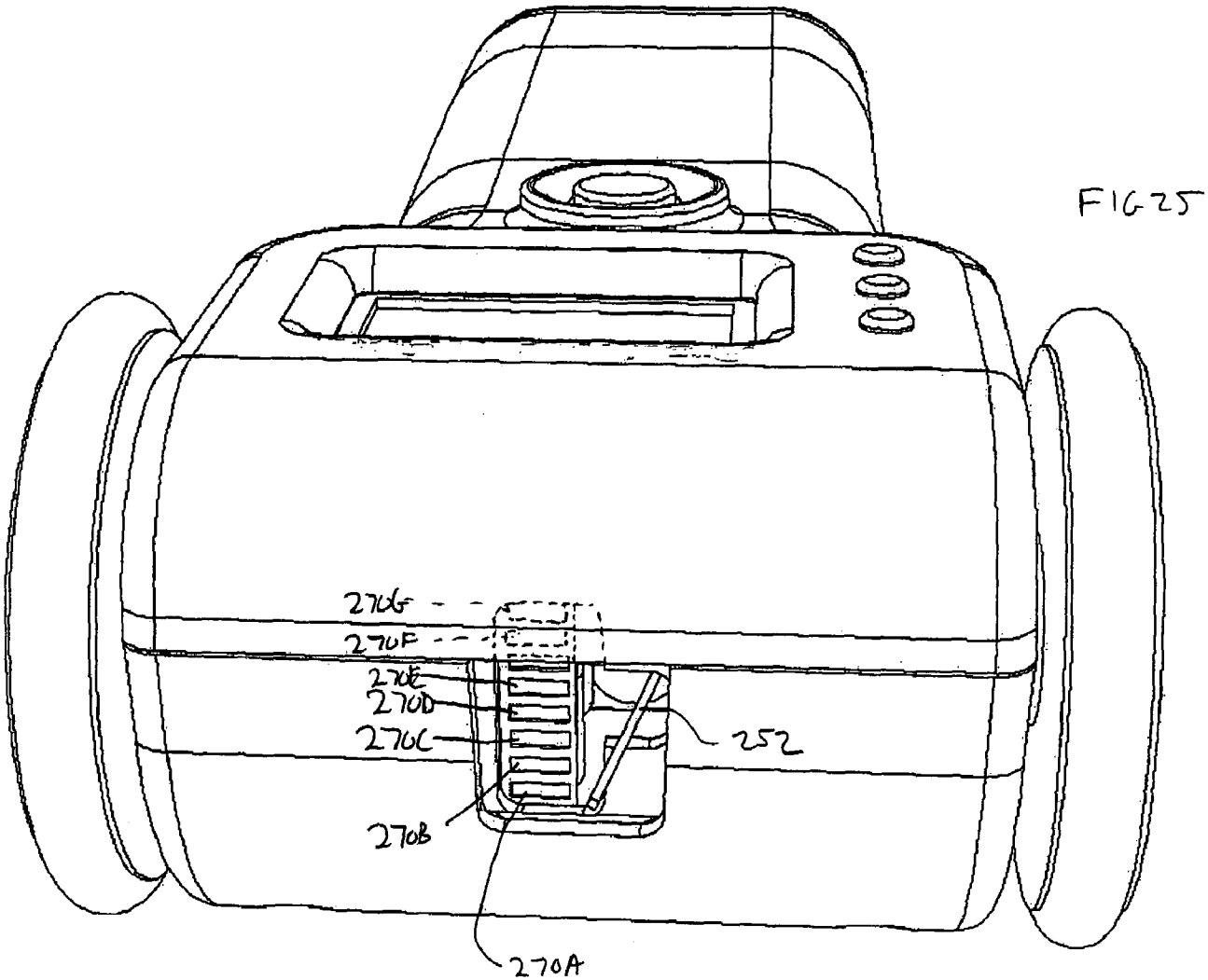
FIG. 25 is a view of an operative end of the alternate apparatus of FIG. 21.

FIG. 25 shows the detector array 260 as having a number of individual detector elements 270A–270G. In the exemplary embodiment, these represent seven of eight individual cells of an off-the-shelf eight-cell detector array of which one cell is not used so that the array may be positioned to define a central cell with a like number of utilized cells to either side thereof. Other details of operation may be generally similar to those of the first apparatus 20. The presence of only two wheels at like longitudinal position (e.g., coaxial, although non-coaxial wheels such as cambered wheels may be used) raises orientational issues. In general, it may be advantageous to maintain a constant orientation of the apparatus relative to the lite array during traversal. With the apparatus 20, the use of four wheels tends to maintain such an orientation. However, the apparatus 200 may be configured to moderate errors associated with orientational changes. By way of example, with the wheels in a constant position, an orientational change of the body will tend to sweep the beam. However, this change in orientation will also produce an encoder output. To the extent that the beam passes fairly close to the axis of rotation (e.g., the shaft axis), to approximately a first order the encoder output associated with orientation change will compensate for the additional laser sweep. In actual use, the sweep from the orientational change is superposed with the beam traversal associated with traversing the apparatus along the array. Thus, despite possibility of orientational changes, useful output may still be obtained.

Figure 26:
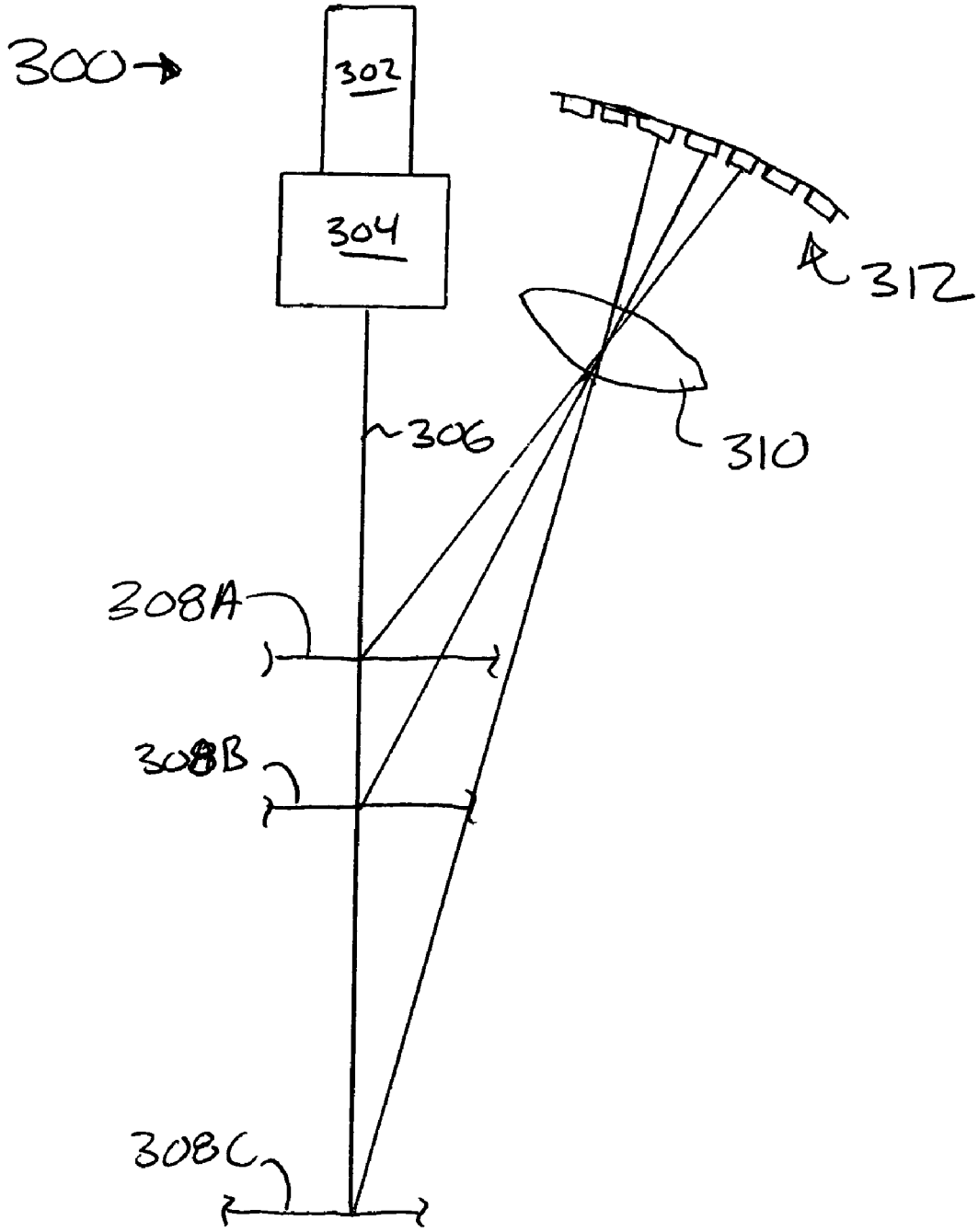
FIG. 26 is a schematic front view of an alternate apparatus.

FIG. 26 shows an alternate apparatus 300 that may be similar to either of the apparatus 20 or 200 but wherein the operation may principally be by depth detection rather than edge detection. This arrangement may be particularly useful for counting non-specular articles such as wood, paperboard, and composite sheets, especially where at least slight misalignment between adjacent articles is expected. The laser diode 302 and optics 304 may be positioned to direct a beam 306 normal to the direction of traversal and plane of the array over which the apparatus is traversed. The beam may be diffusely reflected by articles (e.g., 308A, 308B, and 308C at differing depths). The reflected beam may be focused by a lens 310 and directed to the detector array 312. The depth of the article surface will determine the detector(s) to which the focused beam is directed. Depth changes may be associated with counter incrementation. Similar error corrections may be utilized as are utilized with edge counting (e.g., to account for closely aligned groups of articles with little to no change in depth). In yet other variations, off-the-shelf depth detectors using charge coupled device (CCD) detectors may be used. These may provide a particularly fine resolution (e.g., unavailable with a PIN photodiode array).

One or more embodiments of the present invention have been described. Nevertheless, it will be understood that various modifications may be made without departing from the spirit and scope of the invention. For example, details of the counting apparatus may be configured for a particular lite-counting application. Accordingly, other embodiments are within the scope of the following claims.

What is claimed is:

1. An apparatus for counting articles in a longitudinal array of articles, the apparatus comprising:

a wheel positioned so as to rotate during a traversal by the apparatus of a peripheral portion of the array;

an encoder coupled to the wheel so as to provide an output indicative of a length of said traversal;

a radiant energy source positioned to direct radiant energy toward the array during said traversal;

means for detecting a return of said radiant energy from the array during said traversal along a plurality of different return paths; and a logic circuit coupled to the encoder and the means for detecting for counting said articles in said array.

2. The apparatus of claim 1 further comprising:

a single additional wheel positioned so as to rotate during the traversal by the apparatus of the peripheral portion of the array, the single additional wheel being at like longitudinal position to said wheel.

3. The apparatus of claim 2 further comprising:

a body tapering from a proximal portion adjacent the wheel and additional wheel to a handle portion, the handle portion containing a rechargeable power source.

4. The apparatus of claim 1 further comprising:

a second wheel; and an endless loop tread engaged to the wheel and second wheel and positioned so at to contact the array during said traversal so as to rotate the wheel during said traversal.

5. The apparatus of claim 4 further comprising:

third and fourth wheels; and a second endless loop tread engaged to the third and fourth wheels and positioned so at to contact the array during said traversal so as to rotate the third and fourth wheels during said traversal.

6. The apparatus of claim 1 further comprising:

a handle having:

a grip;

a shaft extending from the grip and having a length effective to space the wheel from the grip by a distance of at least 0.2 m; and at least one input device electrically or electronically coupled to the logic circuit and positioned to receive input from a hand of the user while said hand is on the grip.

7. The apparatus of claim 1 wherein:

the source comprises a laser diode; and the means for detecting comprises a plurality of detectors positioned to preferentially detect the return along a plurality of different paths.

8. The apparatus of claim 1 wherein:

the logic circuit is configured to calculate a characteristic article thickness.

9. The apparatus of claim 8 wherein:

the logic circuit is configured to update the calculated characteristic article thickness during the traversal.

10. A method for counting articles in a group of articles, the method comprising:

traversing a counting apparatus along a periphery of the group, the traversing causing:

rotation of a rotary member; and at least one incident beam of radiation to traverse the group;

detecting an amount of said rotation;

detecting a radiation return resulting from said at least one incident beam including detecting a first return from sides of one or more of the articles and a second return from edges of one or more of the articles and having a greater and more rapid fluctuation in path than the first return including detection of a plurality of different paths of at least said second return, the detection by a plurality of detectors associated with said plurality of different paths of said radiation return; and determining a count of said articles responsive to a combination of the amount of said rotation and the radiation return.

11. The method of claim 10 wherein the detecting comprises detecting relative degrees of fluctuation of said first and second returns.

12. The method of claim 10 wherein the articles are glass lites and the traversing comprises rolling the apparatus over edges of the lites.

13. The method of claim 12 wherein the lites are at least partially within a carton.

14. The method of claim 12 wherein the lites are horizontally arrayed.

15. An apparatus for counting articles in a longitudinal array of articles, the apparatus comprising:

a wheel positioned so as to rotate during a traversal by the apparatus of a peripheral portion of the array;

an encoder coupled to the wheel so as to provide an output indicative of a length of said traversal;

a radiant energy source positioned to direct radiant energy toward the array during said traversal;

a plurality of detectors positioned to detect a return of said radiant energy from the array during said traversal and positioned to preferentially detect the return along a plurality of different return paths; and a logic circuit coupled to the encoder and the plurality of detectors for counting said articles in said array.

16. An apparatus for counting articles in a longitudinal array of articles, the apparatus comprising:

a wheel positioned so as to rotate during a traversal by the apparatus of a peripheral portion of the array;

an encoder coupled to the wheel so as to provide an output indicative of a length of said traversal;

a radiant energy source positioned to direct radiant energy toward the array during said traversal;

at least one detector for detecting a return of said radiant energy from the array during said traversal along a plurality of different return paths;

a logic circuit coupled to the encoder and the at least one detector for counting said articles in said array; and a handle having:

a grip;

a shaft extending from the grip and having a length effective to space the wheel from the grip by a distance of at least 0.2 m; and at least one input device electrically or electronically coupled to the logic circuit and positioned to receive input from a hand of the user while said hand is on the grip.

* * * * *